US005665931A

United States Patent [19]

Washiyama

[11] Patent Number: 5,665,931

[45] Date of Patent: Sep. 9, 1997

[54] APPARATUS FOR AND METHOD OF GENERATING MUSICAL TONES

[75] Inventor: Yutaka Washiyama, Hamamatsu, Japan

[73] Assignee: Kawai Musical Inst. Mfg. Co., Ltd., Shizuoka-ken, Japan

[21] Appl. No.: 312,612

[22] Filed: Sep. 27, 1994

[30] Foreign Application Priority Data

Sep. 27, 1993 [JP] Japan ..... 5-239669

[51] Int. Cl.[6] ..... G10H 7/00; G10H 1/06

[52] U.S. Cl. ..... 84/623; 84/627

[58] Field of Search ..... 84/602, 604, 623, 84/627, 625, 603, 607, 624, 626

[56] References Cited

U.S. PATENT DOCUMENTS

| | | | |
|---|---|---|---|
| Re. 32,862 | 2/1989 | Wachi | 84/1.21 |
| 4,406,204 | 9/1983 | Katoh | 84/1.19 |
| 4,422,362 | 12/1983 | Chibana | 84/1.19 |
| 5,138,927 | 8/1992 | Nishimoto | 84/624 |
| 5,264,657 | 11/1993 | Takauji | 84/607 |
| 5,382,749 | 1/1995 | Fujita et al. | 84/603 |
| 5,401,897 | 3/1995 | Depalle et al. | 84/625 |
| 5,412,152 | 5/1995 | Kageyama et al. | 84/607 |

*Primary Examiner*—William M. Shoop, Jr.
*Assistant Examiner*—Marlon T. Fletcher

[57] ABSTRACT

According to the invention, formant waveform signals which are waveforms synthesized from frequency components corresponding to formants of musical tones, are stored and read out or generated. When such formant waveform signal is read out or generated, the density of frequency components of the formant of the formant waveform signal is controlled and also the frequency of a formant center signal which is to be synthesized is a center signal with the formant waveform signal is controlled. In this way, the formant waveform signal is synthesized on the formant center signal. Thus, the density of formant frequency components and the formant center signal frequency can be controlled separately and independently. Further, the kind of formant waveform signal is switched according to musical factors of musical tone. Thus, different kinds of formant waveform signals to be output are switched according to musical factors of musical tones.

24 Claims, 16 Drawing Sheets

FRM. FORM
(a)
(b)
(c)
(d)
(e)
(f)
FRM. CARRIER SYNTHESIS
FRM. CARRIER SYNTHESIS
ωc
ωc

LINEAR OPE.

$Val_j += Val_j \pm SP_j$

EXPONENTIAL OPE.

$Val_j += (O_j - Val_j) \times SP_j + Val_j$

| U/D | ΔSB | OPE. FORMULA Σωf | GATE OUTPUT cont.(515) |
|---|---|---|---|
| 0 | 1 | Ea+Δ | 0 |
| 0 | 0 | Ea−Δ | 1 |
| 1 | 0 | Ta+Δ | 0 |
| 1 | 1 | Ta−Δ | 1 |

APPARATUS FOR AND METHOD OF GENERATING MUSICAL TONES

BACKGROUND OF THE INVENTION

1. Field of the Invention

This invention relates to an apparatus for and a method of generating musical tones, and more particularly, to the generation of formant waveform signals having waveforms obtained by synthesizing frequency components corresponding to specific formants of musical tones.

2. Description of the Related Art

In the field of musical tone generation apparatus and method, there has seldom been apparatus for performing control concerning formant. However, there has been apparatus, in which formant waveform signals obtained by synthesizing frequency components in a specific frequency band corresponding to specific formants are stored in a memory and read out by supplying read address data thereto.

Such apparatus, however, only permits the formant waveform signals to be merely read out and cannot change contents of the musical tones. For example when a designated tone pitch is changed, the increment rate of the read address data is changed. In this way, it is possible to generate a formant waveform signal corresponding to the tone pitch. However, the width and the density of frequency components of the formant of the formant waveform signal are changed in proportion to the change in the tone pitch. While there is no problem where such proportional changes are permissible, there are many cases where such changes are not permissible or changes other than the proportional ones are required. Therefore, it has been impossible to generate formant waveform signals, in which the density of the formant frequency components has no bearing on the tone pitch changes.

SUMMARY OF THE INVENTION

The present invention solves the above problems, and its object is to permit the density of frequency components of the formant waveform signal to be changed independently of tone pitch changes.

To attain the above object, according to the invention, when reading out or generating a formant waveform signal, the density of the formant frequency components of the formant waveform signal is controlled, and also the frequency of a carrier signal synthesized as a formant center signal with the formant waveform signal is controlled, whereby the formant waveform signal is synthesized on the carrier signal.

Thus, the control of the density of the formant frequency components and the control of the frequency of the carrier signal synthesized as formant center signal with the formant waveform signal can be made separately and independently. Thus, it is possible to vary the contents of the formant waveform signal as desired.

Further, according to the invention a kind of formant waveform signal that is read out or generated is switched according to musical factors indicative of touch data or tone pitch range data of musical tones.

Thus, the kind of formant waveform signal that is output can be switched variously according to changes in the touch data or tone pitch range data of the musical tone under control. It is thus possible to generate richly varying musical tones.

BRIEF DESCRIPTION OF THE DRAWINGS

FIG. 5 is a circuit diagram showing a formant control parameter generator 40;

FRM.:FORMANT, SIG.:SIGNAL, ADD.(ES):ADDRESS(ES), OPE:OPERATION, CONT.:CONTROLLER, LA.:LATCH, MEM.:MEMORY.

DETAILED DESCRIPTION OF THE PREFERRED EMBODIMENTS

Summary of the Embodiments

Figure 3A:
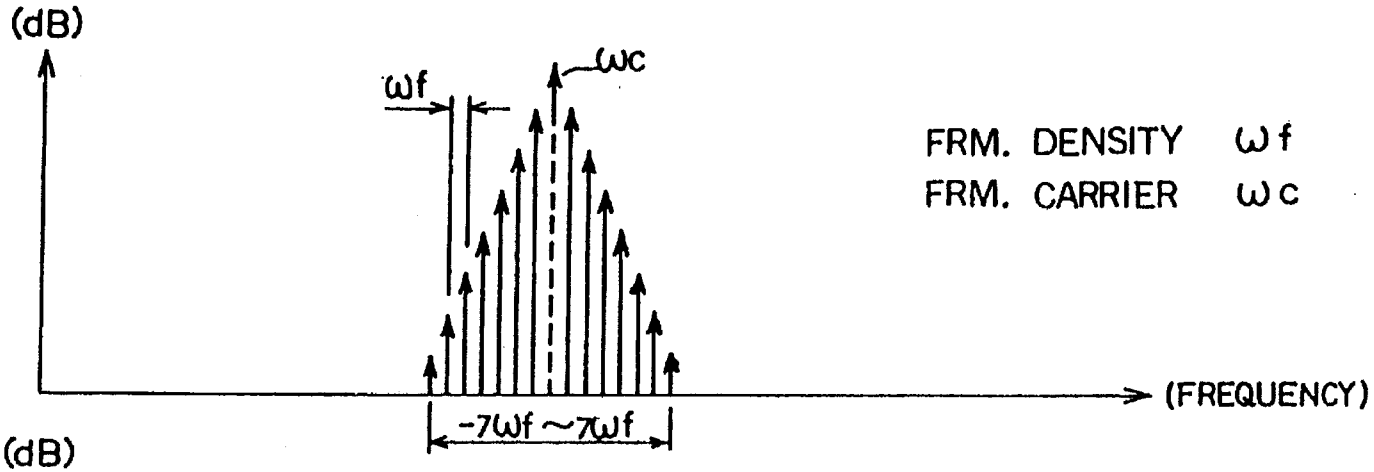
FIGS. 3(*a*) and 3(*b*) are views showing the relation between formant form and formant density parameter ωfj(t)
Figure 3B:
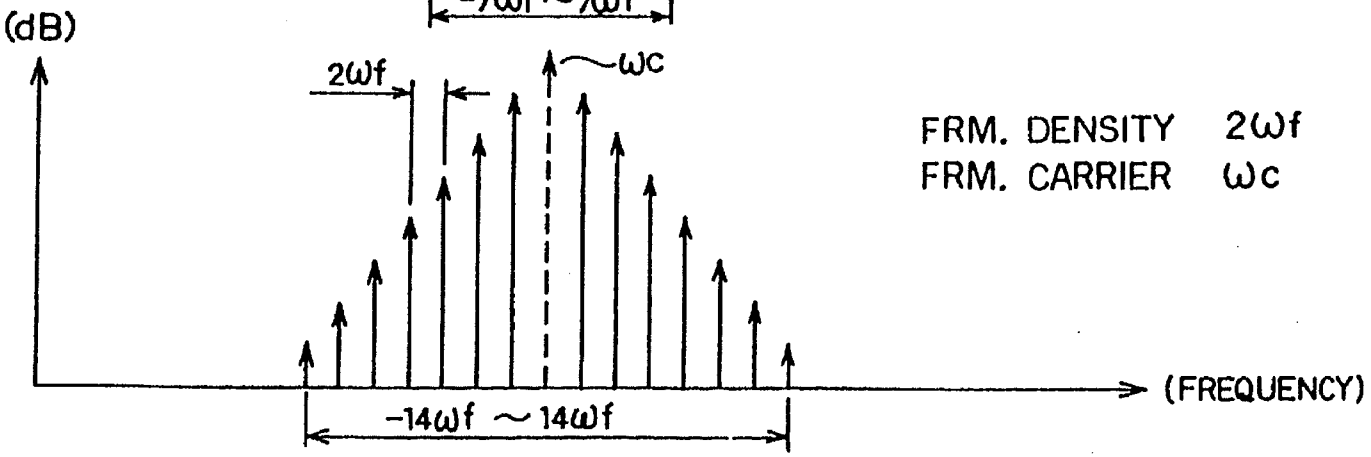

In formant waveform memory 53, formant waveform signals Ffj(t) synthesized from frequency components in frequency bands corresponding to a plurality of different specific formants are stored. Read address data are set in a formant density storage 52 by a controller 20 according to such musical factors as tone color, touch, tone pitch range, etc. Readout formant waveform signal Ffj(t) (formant waveform signal Fj(t)) is multiplication synthesized in a multiplier 66 on formant carrier signal cosωc(t) as formant center signal. The density of formant frequency components of the formant waveform signal Ffj(t) is changed according to parameter Σωfj(t) indicative of the rate of reading of the signal Ffj(t), as shown in FIG. 3.

1. Overall Circuitry

Figure 1:
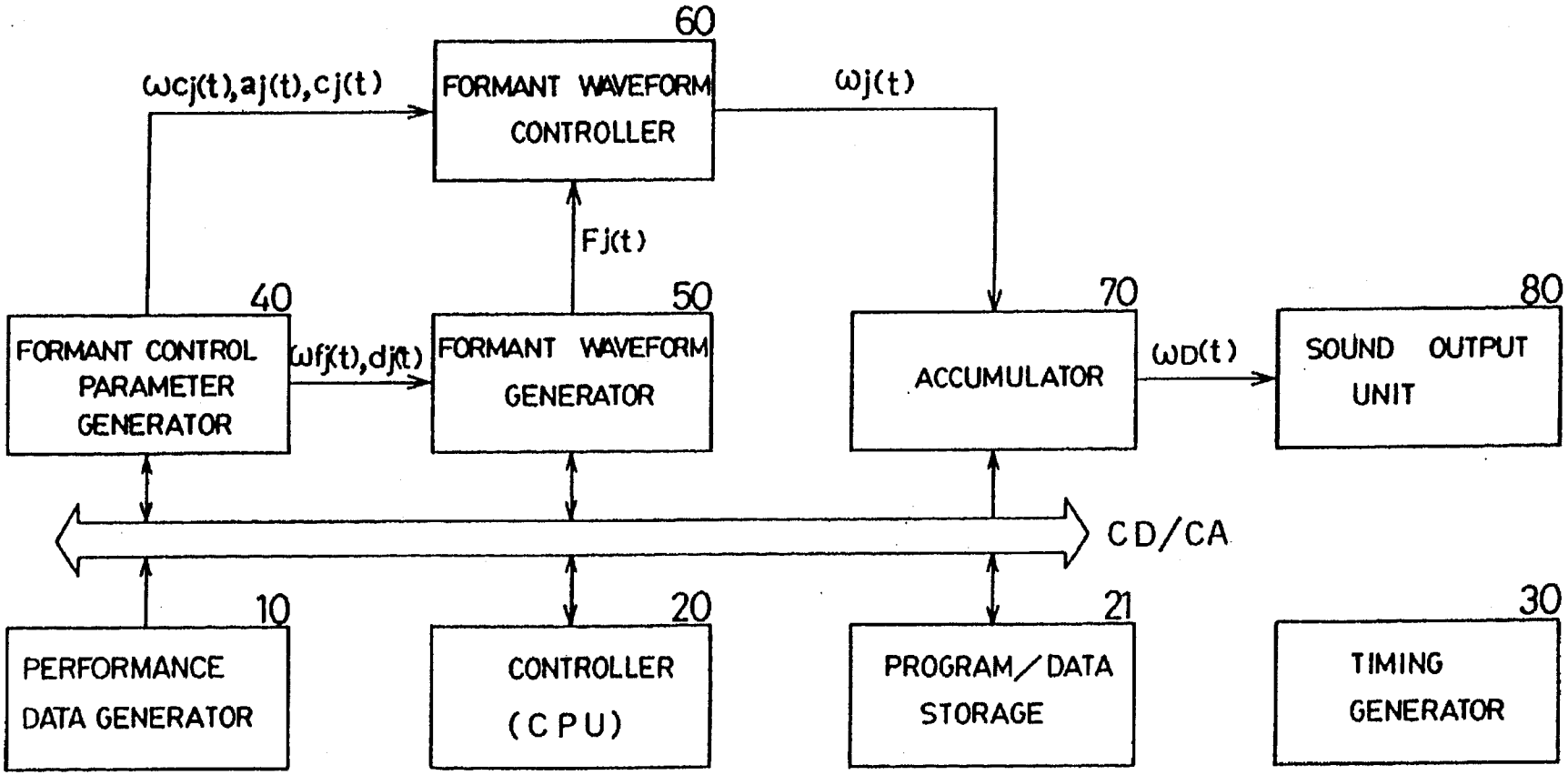
FIG. 1 is a block diagram showing a musical tone generation apparatus.

FIG. 1 shows the overall circuitry of the musical tone generation apparatus. A performance data generator 10 generates tone pitch data and other performance data. The performance data generator 10 is a sounding designation unit for playing music by manual operation, an auto play unit or an interface. Among the performance data that are generated by the performance data generator 10 are musical factor data, for example tone pitch data (tone pitch range data, upper keyboard, lower keyboard and pedal keyboard)), data of time elapsed from the start of sounding, performance part data, musical tone part data, musical instrument part data and other data. The sounding designation unit may include keyboard instruments, string instruments, wind instruments, percussion instruments, computer keyboards, etc. The auto play unit automatically reproduces stored performance data. The interface is a MIDI (musical instrument digital interface) or the like which receives performance data from a unit connected to the interface or sends performance data to the connected unit.

The performance data generator 10 has various switches, such as timbre tablets, effect switches, rhythm switches, pedals, wheels, levers, dials, handles, touch switches, etc., which are for musical instruments. From these various switches musical factor data are input. Among the musical factor data are timbre data, touch data (indicative of the speed/strength of sound designation operation), effect data, rhythm data, stereo data, quantization data, modulation data, tempo.data, volume data, envelope data, data of time elapsed from the start of sounding, etc.

These musical factor data are included in the performance data and are input from the various switches noted above. Further, these musical factor data are contained in the auto performance data or in performance data that are transmitted or received via the interface. The touch switches are provided in one-to-one correspondence to sounding designation units, and the touch switches generate initial touch data and after touch data indicative of the speed and strength of touch. The timbre data correspond to tones of musical instruments such as keyboard instruments (e.g., piano), wind instruments (e.g., flute), string instruments (e.g., violin), percussion instruments (e.g., drums), etc. The envelope data are envelope level data, envelope phase data etc. The performance part data, musical tone part data and musical instrument part data correspond to, for instance, melody, accompaniment, chord, base, etc. and also correspond to upper keyboard, lower keyboard, foot keyboard, etc. These musical factor data are supplied to controller 20 for the switching of various signals, data and parameters as will be described later.

The performance data are processed in the controller 20, and various data thus produced are fed to a formant control parameter generator 40, a formant waveform generator 50 and an accumulator 70 to generate formant synthesis signal Wj(t). The controller 20 is constituted by a CPU etc. A program/data storage 21 is constituted by such storage units as ROM and RAM. In the program/data storage 21 are stored programs for various processes which are executed by the controller 20 as well as the various data noted above and various other data. Among the various data are those necessary for time division processes and those for assignment of time division channels.

The formant synthesis signal Wj(t) is generated on a time division basis through the formant control parameter generator 40, formant waveform generator 50 and formant waveform controller 60. In Wj(t), "j" indicates the division order of time division process or channel number. The formant control parameter generator 40 can generate various parameters, i.e., formant control parameters ωcj(t), ωfj(t), aj(t), cj(t), dj(t), etc., which are necessary for generating the formant synthesis signal Wj(t).

These parameters will be described later in detail. Through the formant waveform generator 50 and formant waveform controller 50, formant synthesis signal Wj(t) is read out, generated and synthesized according to the formant control parameter input. The formant synthesis signal Wj(t) is accumulated and synthesized for each group channel in the accumulator 70 to be output and sounded as musical tone from a sounding unit 80.

From a timing generator 30 timing control signals for synchronizing the entire circuitry of the musical tone generation apparatus are output to the individual circuits. Among the timing control signals are clock signals at various frequencies, the AND or OR of these clock signals, a signal at a frequency corresponding to the channel division time in the time division process, channel number data j, etc.

2. Formant Control Parameters and Formants

Figure 2:
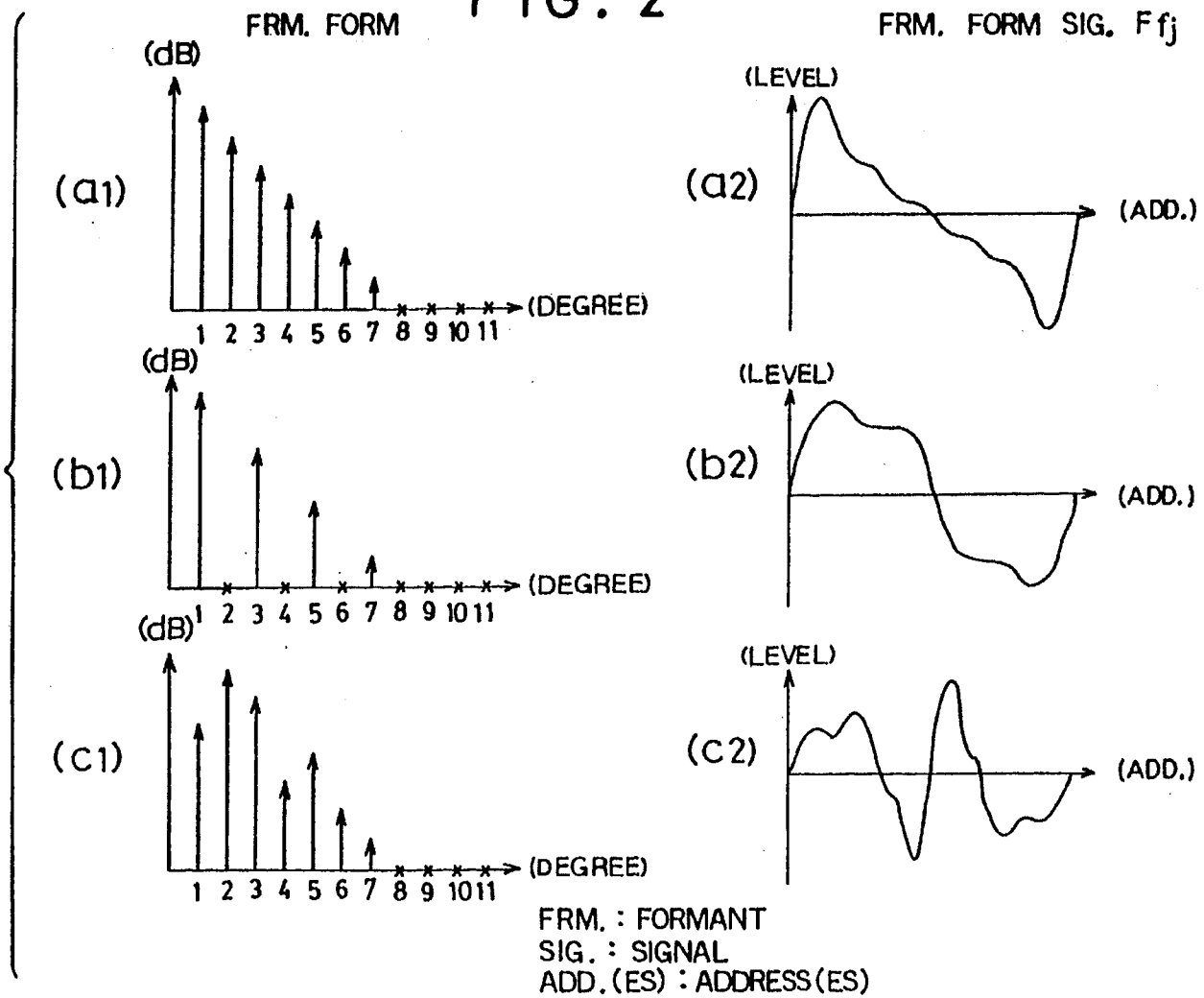
FIGS. 2 (a1), (a2), (b1), (b2), (c1), and (c2) are views showing the correspondence between formant forms and formant waveform signals Ffj(t)
Figure 4:
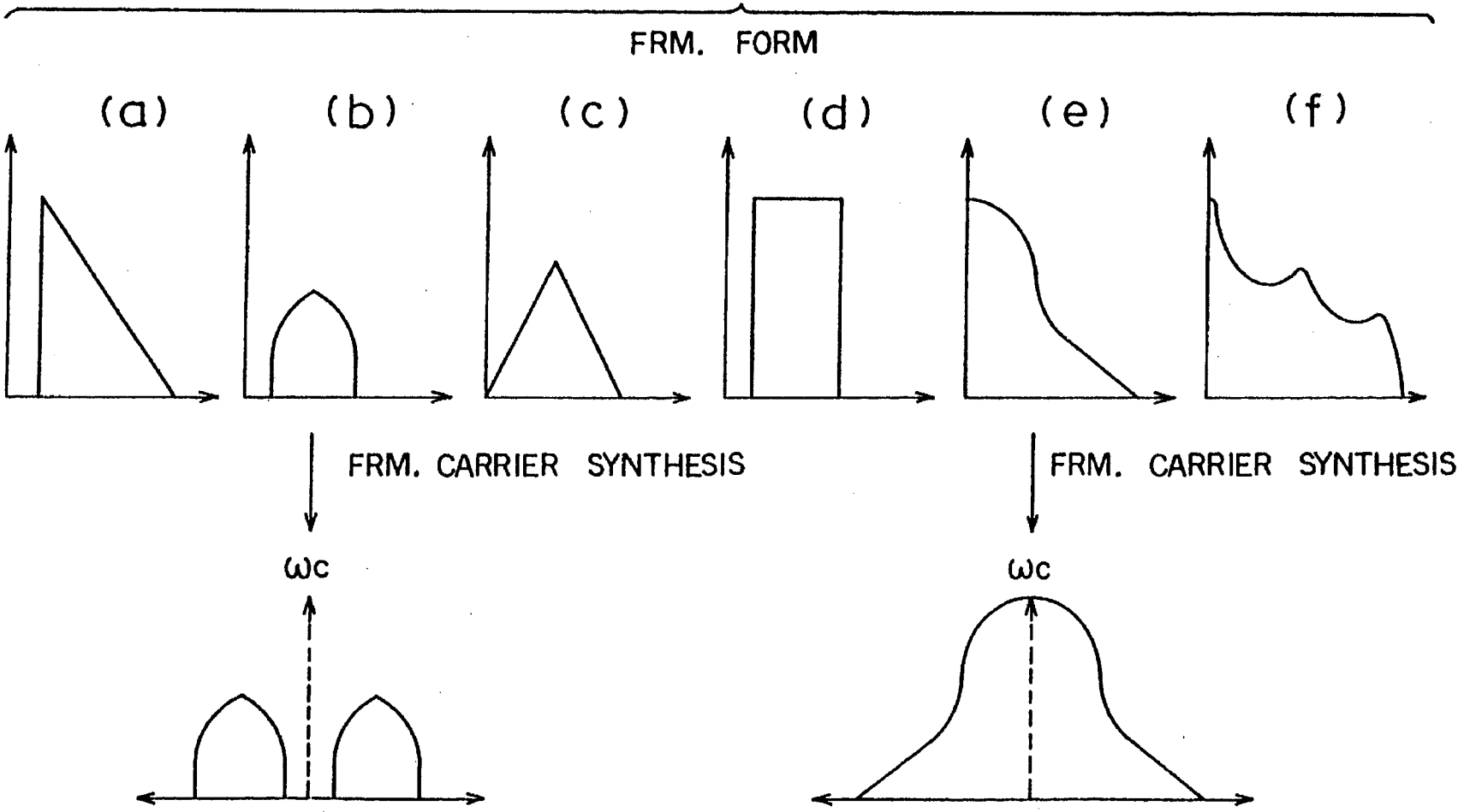
FIGS. 4(*a*) to 4(*f*) are views showing various formant forms.
Figure 4:
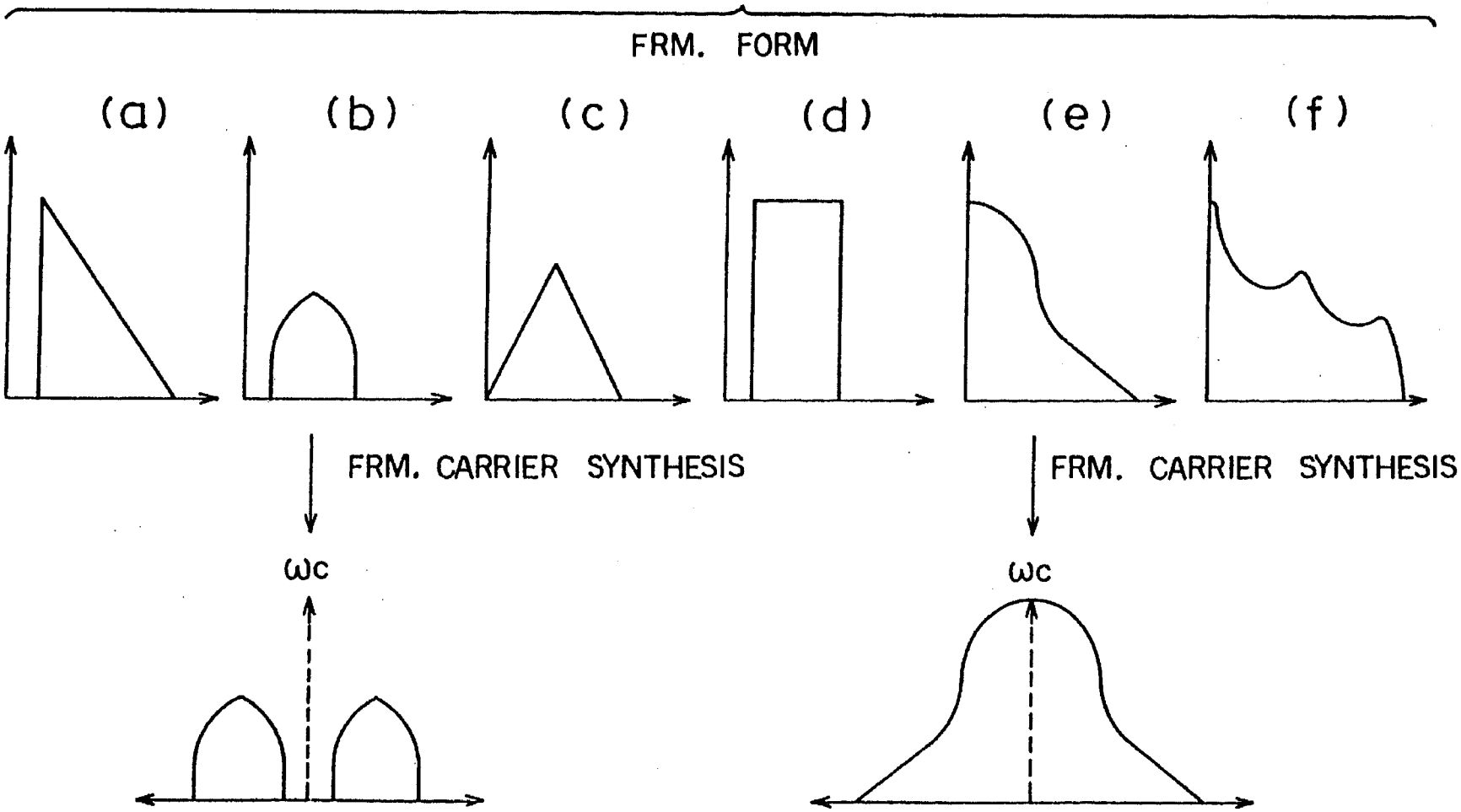

FIGS. 2 to 4 show the relation between the formant control parameter noted above and formant. FIG. 2 shows simple examples of the correspondence between formant and formant waveform signal Ffj(t). Referring to FIG. 2, in (a1) it is shown that the levels of the first harmonics (fundamental wave), second harmonics, third harmonics, . . . , of frequency spectrum components are successively reduced with an equal difference. The formant form in (a1) is a half triangle form. Shown in (a2) is the waveform of the formant waveform signal Ffj(t) which is obtained as a result of synthesizing the frequency components in a specific frequency band corresponding to the formant of musical tone (of musical instruments) shown in (a1).

Shown in (b1) is a formant form which is obtained by selecting only the odd number ones of the frequency spectrum components shown in (a1). While this formant form is also half triangular, the corresponding synthesized formant waveform signal Ffj(t) has a waveform as shown in (b2). Shown in (cl) is a formant form obtained by changing the levels of the orders of the frequency spectrum components in (a1). This formant form is a two-hill form, and the corresponding synthesized formant waveform signal Ffj(t) has a waveform as shown in (c2).

The illustrative formant waveform signals Ffj(t) are only examples, and it is possible to realize various formant waveform signals Ffj(t) by varying the formant form. Such various formant waveform signals Ffj(t) are stored in a formant waveform memory 53 which will be described later. The frequencies of the frequency spectrum components in (a1), (b1) and (c1) in FIG. 2 are in integral ratio relation to one another, but it is also possible to relate the frequencies in non-integral ratio relation. Such non-integral ratio relation formant waveform signals Ffj(t) are also stored in the formant waveform memory 53.

In FIG. 3, shown in (a) are the frequency spectral components of a musical tone waveform obtained as a result of synthesis of the formant waveform Ffj(t) shown in FIG. 2 (a2), on formant carrier signal cosωc(t) as the formant center signal (fundamental wave). The formant waveform Ffj(t) is read out at a rate corresponding to formant density parameter wfj(t), one of the formant control parameters. As the frequency spectrum of the resultant signal of synthesis of the formant waveform signal Ffj(t) on the formant carrier signal cosωc(t), the formant shown in (a1) in FIG. 2 is formed on both sides of formant carrier parameter ωc as the center. In this case the other formants except FIG. 2 (a1) are formed, but are not shown in this FIG. 2. The formant carrier parameter ωc determines the frequency of the formant carrier signal (or formant center signal) cosωc(t).

When the formant waveform signal Ffj(t) in (a2) in FIG. 2 is read out at a rate corresponding to the formant density parameter ωf, the formant has a width of ±7 wf vertically as shown in (*a*) in FIG. 3. When the formant waveform signal Ffj(t) is read out at double the rate corresponding to the formant density parameter wf, the width of the formant is spread to ±14 ωf vertically as shown in (b) in FIG. 3.

Thus, the formant density parameter ωf determines the width of the formant, i.e., the density of the frequency components of the formant. Further, a change in the value of the formant density parameter ωf causes the formant itself to slide along the frequency axis. Thus, the formant density parameter ωf further determines the position of the formant on the frequency axis.

FIG. 4 shows forms of formants corresponding to various formant waveform signals Ffj(t), the forms being half triangular, pot-like, triangular, rectangular, etc. There are various other forms such as half circular, hill-like, two-hill-like, etc. Further, there are composite formants consisting of pluralities of these (like) formants combined (synthesized) to be or not to be overlapped. By synthesizing such a formant waveform signal Ffj(t) on the formant carrier signal cosωc(t), a line symmetry formant as shown in (b) in FIG. 4 is formed. Thus, with the same form of formant of the formant waveform signal Ffj(t), different formants are obtainable through synthesis on the formant carrier signal by shifting the formant along the frequency axis. Thus, it is possible to vary the character of musical tones that are output as a result of the synthesis.

To the formant waveform signal Ffj(t) is added formant waveform bias parameter dj(t). The signal after the addition is also called formant waveform signal Fj(t). The formant waveform bias parameter dj(t) is a factor which determines the level or bias of the formant waveform signal Ffj(t), and the strength of the formant is determined by the magnitude of the formant waveform bias parameter dj(t). The addition of the formant waveform bias parameter dj(t) may be replaced with multiplication thereby, with both the addition and multiplication or all kinds of calculations (1) will be described later in detail. With multiplication synthesis of the formant waveform signal Fj(t) on the formant carrier signal cosωct as the formant center signal, a musical tone having the corresponding tone pitch can be realized. In this case, the formant waveform signal Fj(t) is synthesized not only as harmonic components but also as subharmonic components on the formant carrier signal cosωct, thus providing the synthesized musical tone with a spread.

When the formant density parameter ωfj(t) which determines the rate of reading of the formant waveform signal Fj(t) (formant waveform signal Ffj(t)) is changed according to the designated tone pitch, the formant waveform signal Fj(t) itself is changed to correspond to the tone pitch, but it is no longer possible to control the formant density of the formant waveform signal Fj(t) independently of the tone pitch. The multiplication of the formant carrier signal cosωct by the formant waveform signal Fj(t) may be replaced with addition, by both the addition and multiplication or all kinds of calculations (1) to be described later in detail.

The formant carrier signal cosωct may be multiplied by the formant carrier level parameter aj(t), and formant carrier bias parameter c(t) is added. The formant carrier level parameter aj(t) and formant carrier bias parameter cj(t) are factors which determine the level of the formant carrier signal cosωct, a value of the both parameter aj(t) and cj(t) determine a strength of the musical sound. The formant carrier level parameter aj(t) has the same character as amplitude modulation signal, and by varying the value of the formant carrier level parameter aj(t), it is possible to obtain, in addition to the amplitude modulation effect, envelope control, stereo position control, measurement of the elapsed time from the start of sounding, etc.

The formant synthesis signal Wj(t) is expressed with the above formant control parameters ωcj(t), aj(t), cj(t) and dj(t) and the formant waveform signal Ffj(t) as follows.

$$Wj(t)=\{aj(t)\times\cos\omega cj(t)+cj(t)\}\times\{Ffj(t)+dj(t)\}$$

The formant carrier signal cosωct may or may not be in accord with the formant center signal at the formant peak corresponding to the formant waveform signal Ffj(t). For example, the level (amplitude) of the formant carrier signal cosωct is lower than the level at the formant peak point corresponding to the formant waveform signal Ffj(t). This can be attained by adequately selecting the values of the formant control parameters aj(t), cj(t) and dj(t).

3. Formant Control Parameter Generator 40

FIG. 5 shows the formant control parameter generator 40. Formant control parameters corresponding to the method of play as noted above, are written in the parameter storage 41 by the controller 20. Such formant control parameters are calculated (computed) and processed in the function operation unit 42, and the result is then written again in the parameter storage 41. In this way, the formant control parameters ωfj(t), aj(t), aj(t), cj(t) and dj(t) are updated.

Actually, there are provided five formant control parameter generators 40 for operation on the formant density parameter ωfj(t), formant carrier parameter ωcj(t), formant carrier level parameter aj(t), formant waveform bias parameter dj(t) and formant carrier bias parameter cj(t), respectively. Thus, the formant control parameters ωfj(t), ωcj(t), aj(t), cj(t) and dj(t) can be generated as parallel data.

4. Parameter Storage 41

Figure 6:
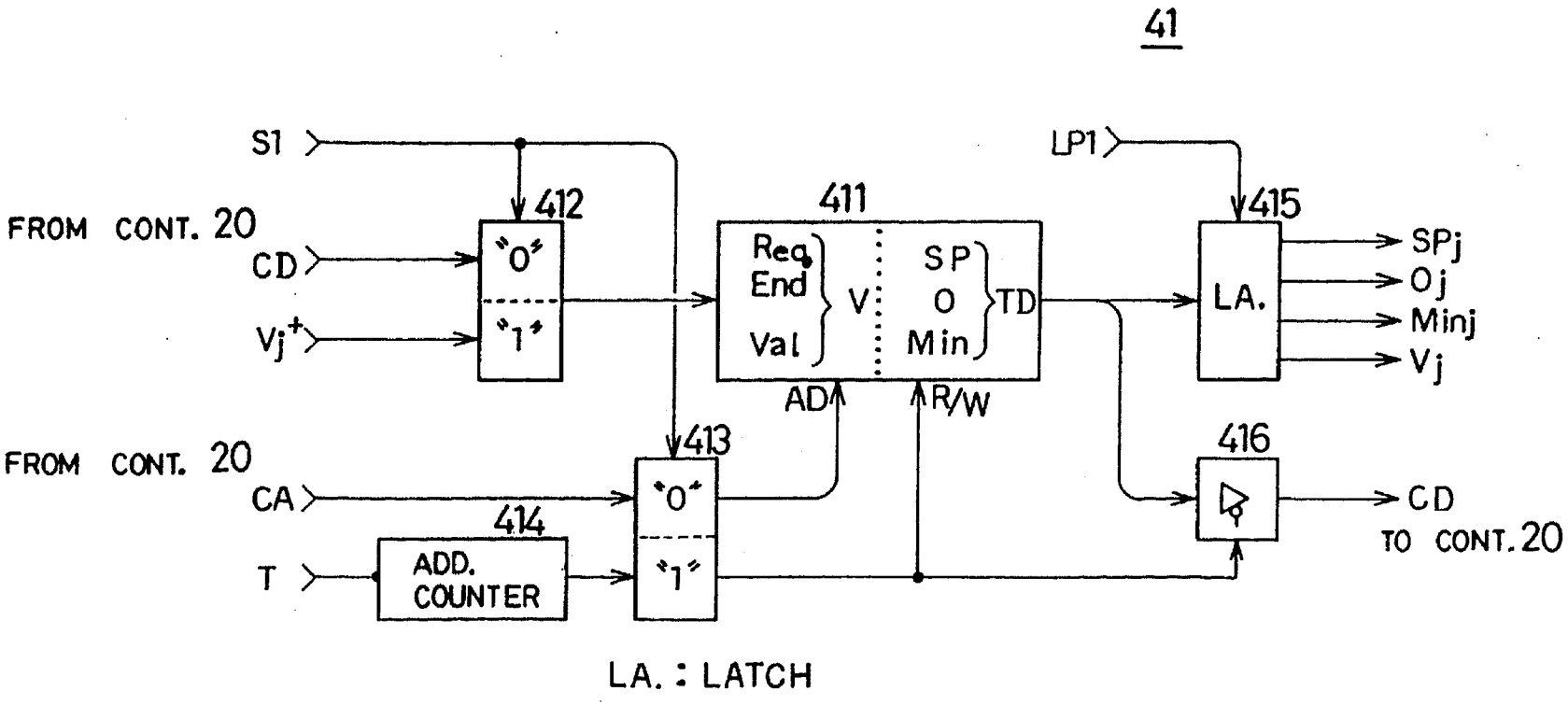
FIG. 6 is a circuit diagram showing a parameter storage 41.

FIG. 6 shows the parameter storage 41. Again there are provided five parameter storages 41 for the respective formant control parameters ωfj(t), ωcj(t), aj(t), cj(t) and dj(t). In the following description only one of the five parameter storages 41 and the formant control parameter Valj(Vj) will be explained.

Formant control parameter CD is fed from the controller 20 through a selector 412 to be written in a parameter memory 411. This writing is done, for instance, at the time of the start of sounding, i.e., at the time of the generation of an event signal for the sounding operation, or at the time of channel assignment to the musical tone to be sounded. This formant control parameter CD is written as formant control parameter TD, and the formant control parameter TD includes speed data SP, objective data O and mini data Min.

The speed data SP indicates the formant control parameter operation speed, i.e., operation step value. The objective data indicates the objective value of the operation. The mini data Min indicates a value which is to be subtracted from the objective data O to obtain data right before the objective data O. The controller 20 selects the speed data SP, objective data O and mini data Min according to the musical factor data indicative of the timbre, touch, tone pitch range, etc. input from the performance data generator 10, elapsed time from the start of sounding, envelope level, envelope phase, etc. to be described later, input data or select data by operator, etc. These speed data SP, objective data O and mini data Min may be input from the performance data generator 10 by the operator.

Thus, the program/data storage 21 has a corresponding table between the musical factor data, elapsed time from the start of sounding, envelope level or envelope phase, and the speed data SP, objective data O, mini data Min. etc. In this table, data is stored as multiple data corresponding to the musical factor. For example, the data SP, O and Min are stored for each of a plurality of timbres. Of these data, those for one timbre are stored for a plurality of musical instruments parts (tone pitch ranges). Of these data, those for one musical instrument part (tone pitch range) are stored for each touch. Of these data, those for one touch are stored for each elapsed time from the start of sounding, envelope level or envelope phase, and so forth.

Thus, the formant control parameters Valj(ωfj(t), ωcj(t), aj(t), cj(t) and dj(t) are changed according to the musical factor data such as the timbre, touch, tone pitch range, etc., elapsed time from the start of sounding, envelope level, envelope phase or input data or select data by operator.

In this case, as for the musical factors the formant control parameter Valj, time count data, etc. which is changed according to the envelope data or elapsed time is synthesized by all kinds of calculations (1) to be described later in detail. It is possible to omit the storage of data for each elapsed time from the start of sounding or each envelope level, and instead modify for synthesis the elapsed time from the start of sounding of envelope level with respect to each of the data SP, O and Min. The modification synthesis is based on all kinds of calculations (1) to be described later in detail, and an operation (computation) device for the modification synthesis of the elapsed time from the sounding start or envelope level is provided at the output terminal of the parameter storage 41 or the output terminal of the function operation unit 42 shown in FIG. 5.

In the parameter memory 411 formant control parameter V is further stored. This formant control parameter V is obtained as a result of processing the formant control parameter TD in the function operation unit 42, and the formant control parameter V includes parameter value Val, request data Req and end data End.

The parameter value Val is a value of each formant control parameter as calculated in the above operation. The request data Req is to request the commencement of the next operation after the reaching of the objective value by the calculated value. The end data End indicates the end of all the operations with the parameter value Val brought to "O".

The above formant control parameters TD (SP, O and Min) and V are stored in sets corresponding in number to the number of the time division channels in the parameter memory 411. The j-th channel formant control parameters SPj, Oj, Minj and Vj are supplied via latch 415 to the function operation unit 42 for operation, and the results are written again as formant control parameters Vj+ in the parameter memory 411 via a selector 412.

The formant control parameters Req and End in the parameter memory 411 are supplied through a tri-state buffer 416 to the controller 20 for the request of formant control parameters TD (SP, O and Min) necessary for the next operation. Thus, the controller 20 counts the envelope phases for each musical tone. In this case, at the time of the channel assignment to a new musical tone, the envelope phase is cleared, and the request data Req is incremented by "+1" whenever it is supplied to the controller 20. According to such envelope phase, the controller 20 executes switching of various signals, data and parameters as described above or to be described later.

Address data and read/write signal R/W in the parameter memory 411 are supplied from the controller 20 through a selector 413 to the parameter memory 411 and also supplied from an address counter 414 through the selector 413 to the parameter memory 411. The read/write signal R/W is further supplied as a set signal to the tri-state buffer 416.

To the selectors 412 and 413 a select signal S1 is supplied to switch data to be selected. To the latch 415 a latch signal LP1 is supplied. The period of the latch signal LP1 is equal to the channel division time. The latch signal LP1, select signal S1 and count signal T of the address counter 414 are supplied from the timing generator 30.

5. Operation of Parameter Storage 41

Figure 7:
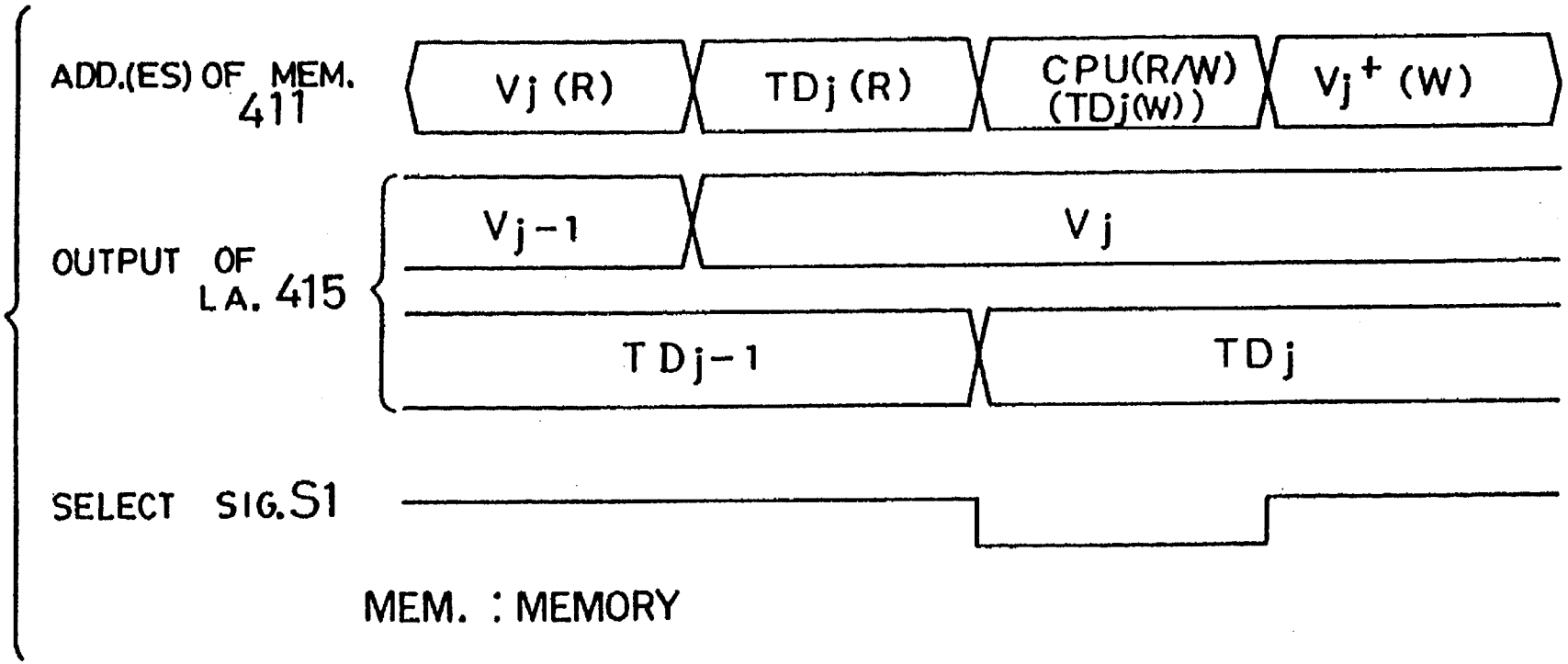
FIG. 7 is a time chart concerning the parameter storage 41.

FIG. 7 is a time chart illustrating the operation of the parameter storage 41. The reading of the j-th channel formant control parameter Vj, reading of the j-th channel formant control parameter TD, accessing of the controller 20 and writing of the formant control parameter Vj+ after operation with respect to the j-th channel, are sequentially switched and repeated. Writing the formant control parameter TD is executed when accessing by the controller 20.

The output of the latch 415 is delayed by one step behind the read and write timings noted above, as shown in FIG. 7. The select signal S1 is at a low level when and only when accessing by the controller 20.

6. Function Operation Unit 42

Figure 8:
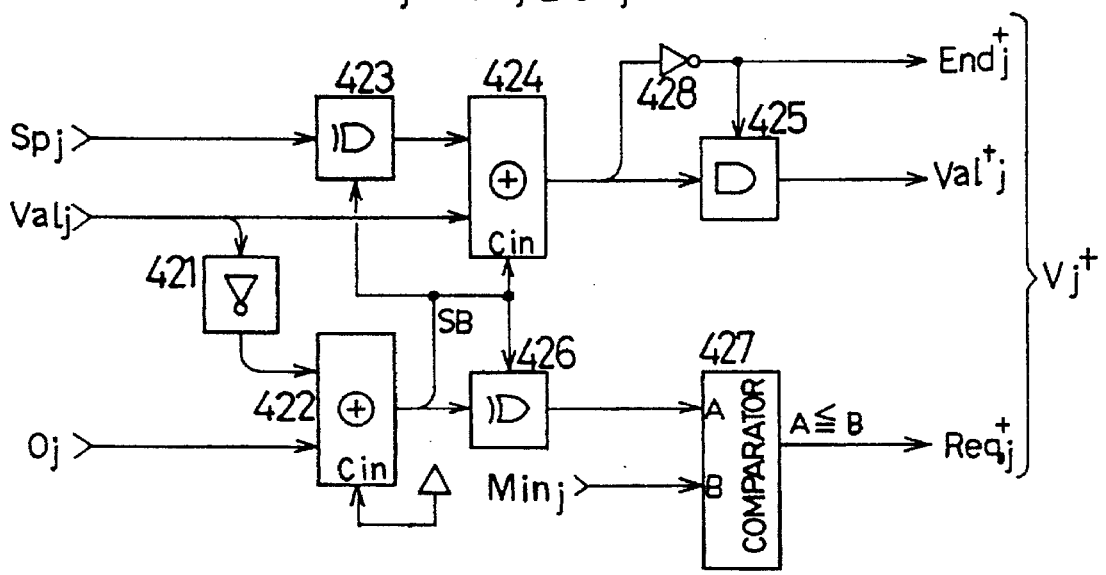
FIG. 8 is a circuit diagram showing a function operation unit 42 for performing linear operation.
Figure 9:
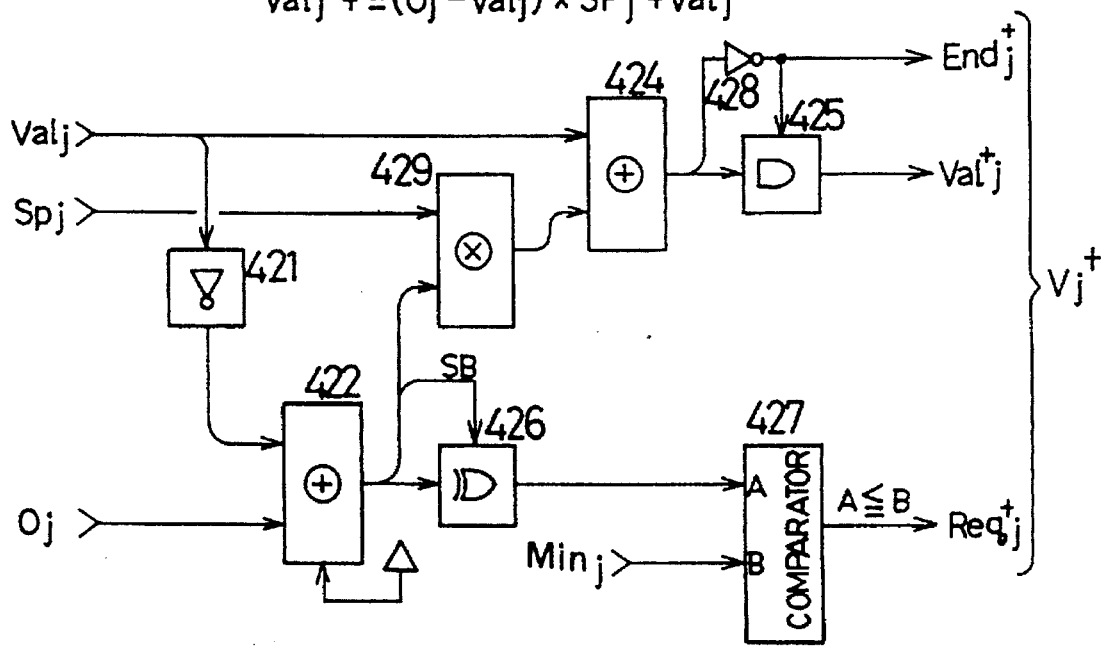
FIG. 9 is a circuit diagram showing a function operation unit 42 for performing exponential operation.

FIGS. 8 and 9 show examples of the function operation unit 42. The function operation unit 42 shown in FIG. 8 performs a linear operation, while the function operation unit 42 shown in FIG. 9 performs an exponential operation. An adder 424 adds the parameter value Valj and speed data SPj from an exclusive OR gate group 423, and its output is coupled through an AND gate group 425 to provide a new parameter value Valj+.

The parameter value Valj is sign inverted in an inverter group 421 before being added to the objective data Oj in an adder 422, and the sum output thereof is incremented by "+1". Thus, the parameter data Valj is subtracted from the objective data Oj. The sign bit SB of the subtraction data is supplied to the exclusive OR gate group 423 and also supplied as "+1" increment signal to the adder 424. Thus, when the objective data Oj is less than the parameter value Valj, the speed data SPj is sign inverted, and the speed data SPj is subtracted from the parameter value Valj.

The subtracted (difference) data from the adder 422 is supplied through an exclusive OR gate group 426 to a comparator 427. To the exclusive OR gate group 426 is also supplied the sign bit SB, and when the subtracted (difference) data has a negative value, it is inverted to the positive value. Thus, the exclusive OR gate group 426 provides the absolute value |Oj−Valj| of the difference between the parameter value Valj and the objective value Oj.

This absolute difference |Oj−Valj| is compared in a comparator 427 to the mini data Minj. When the absolute difference |Oj−Valj| becomes less than the mini data Minj, a comparative signal is provided as the request data Req+. The sign bit SB of the parameter value Valj from the adder 424 is inverted in an inverter 428 to be output as the end data Endj+. This end data Endj+ is inverted to a high level when and only when the parameter value Valj becomes negative with the end of the operation. The end data Endj+ is supplied to an AND gate group 425 to make the parameter value Valj+ to be "O". The above operation is expressed as $$Valj+=Valj\pm SPj$$

In the function operation unit 42 shown in FIG. 9 for the exponential operation, difference data (Oj−Valj) between the parameter value Valj and the objective data Oj is obtained through inverter group 421 and adder 422. The difference data is multiplied in a multiplier 429 by the speed data SPj. The product data is added in an adder 424 to the parameter value Valj, and the sum is coupled through an AND gate group 425 to be provided as the parameter value Valj+. The remainder of the operation is the same as in the function operation unit 42 shown in FIG. 8. The above operation is expressed as $$Valj+=(Oj-Valj)\times SPj+Valj$$

The formant control parameters TD (i.e., speed data SP, objective data O and mini data MIN), request data Req and end data End, are used for operations concerning the envelope levels of the attack, decay, sustain and release phases of the envelope waveform or operation concerning the elapsed time from the start till the end of sounding.

In this case, the formant control parameter aj(t) to be described later, which is obtained as a result of the above operation, represents the envelope level, and the formant control parameter cj(t) or dj(t) represents the elapsed time from the start of sounding. If the speed data SP is large or if the objective data O is small, the data obtained as the result of the operation can be used as representing the envelope level. On the other hand, if the speed data SP is small or if the object data O is large, the operation result data can be used as representing the elapsed data from the start of sounding. Such data representing the envelope level or the elapsed time from the start of sounding, are supplied to the controller 20 to switch various signals, data and parameters as described above or to be described later.

The operation result data constitute the formant control parameters Valj (ωfj(t), ωcj(t), aj(t), cj(t) and dj(t). Alternatively, it is possible to fix only values of the parameters ωfj(t) and ωcj(t). Further, it is possible to also fix values of the parameters aj(t), cj(t) and dj(t) or set these parameters to the same value. By so doing, it is possible to provide only a single function operation unit 42 or dispense with some of the function operation units 42. Further, it is possible to vary the parameters ωfj(t) and ωcj(t) for frequency modulation or vary the density of the frequency components of the formant of the formant waveform signal Ffj(t) according to the envelope or the elapsed time from the start of sounding.

The operation in the function operation unit 42 may be replaced with an operation using a digital signal processor, an operation circuit, etc. on the basis of a certain operation formula. Further, in place of the above operation, it is possible that calculated parameter values Val are stored in and successively read out from the memory. In this case, it is possible to use fluctuations (wavering, swings, sways) data FL from a fluctuation data memory 321 or frequency or amplitude modulation data FM1 to FM3, SFM, AM1 to AM3 or SAM described in specification U.S. patent application Ser. No. 08/172,146 (Japan Patent Application Serial No. 04-230136 and 04-346063) as the parameter values Val.

Further, it is possible to replace the circuits shown in FIGS. 8 and 9 with, for instance, a time counter for the operation concerning the formant control parameters Valj (ωfj(t), ωcj(t), aj(t), cj(t) and dj(t)). Such time counter is reset and caused to start counting under control of a sounding operation event signal or a signal produced at the time of the channel assignment to a musical tone to be sounded. The time counter counts the elapsed time from the start of sounding on a time division basis, i.e., for each channel.

Further, cumulative formant density parameter Σωfj(t) or cumulative formant carrier parameter Σωcj(t) represents the read address for the formant waveform signal Ffj(t) or formant carrier signal cosωct. The number of times of repeated reading of such signal and also the value of the cumulative parameter Σωfj(t) or Σωcj(t) (read address) indicate the elapsed time from the start of sounding, and the value may be used as the elapsed time from the start of sounding. Particularly, the value is effective in case where the formant waveform signal Ffj(t) or the formant carrier signal cosωct is stored for a plurality of periods from the rising (attack) or for all the periods from the start till the end of sounding. Such data indicative of the elapsed time from the start of sounding is supplied to the controller 20 to switch various signals, data and parameters as described above or to be described later.

The circuits shown in FIGS. 8 and 9 may both be provided in the musical tone generation apparatus for switching according to the musical factors, envelope phase, envelope level, elapsed time from the start of sounding or input data or select data by operator. As the data for the switching is used some or all of the musical factors from the performance data generator 10 or the parameters Valj(ωfj(t), ωcj(t), aj(t), cj(t) and dj(t)).

7. Formant Waveform Generator 50

Figure 10:
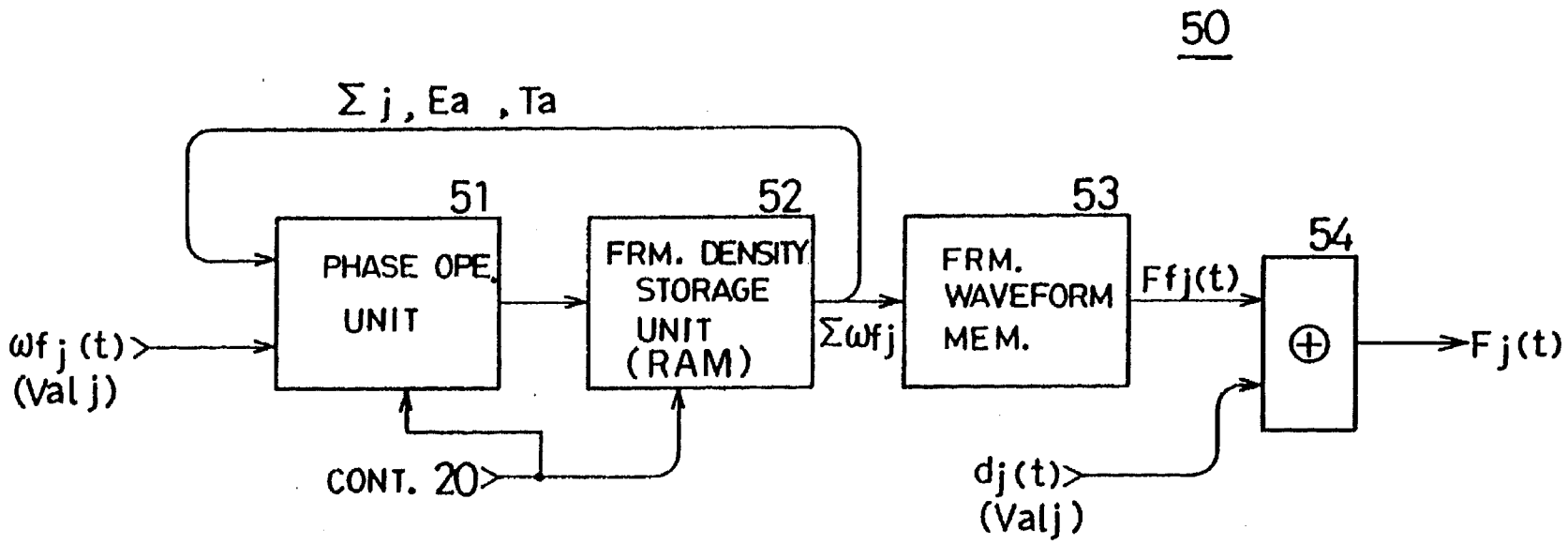
FIG. 10 is a circuit diagram showing a formant waveform generator 50.

FIG. 10 shows the formant waveform generator 50. The formant density parameter ωfj(t) as one of the calculated parameter values Valj noted above is processed in a phase operation unit 51 before being stored in a formant density storage unit 52. This formant density parameter ωfj(t) is stored for all the channels. When stored in the formant density storage unit 52, the formant density parameter ωfj(t) is read out for each channel to be supplied to a formant waveform memory 53 and also fed back to a phase operation unit 51 for accumulation. The start value for the accumulation, i.e., repeat top data Ta, is supplied from the controller 20.

The formant waveform signal Ffj(t) is stored in a large number in the formant waveform memory 53. That is, it is stored for each touch data, each tone pitch range data, timbre data, each elapsed time from the start of sounding, each envelope level, each envelope phase, etc.

It is also possible to store the formant waveform data Ffj(t) in the formant waveform memory 53 for each of other musical factor data, for instance each effect data, each rhythm data, each stereo data, each modulation data, each performance part data, each musical tone or sound part data, each musical instrument part data, etc. That is, the formant waveform data Ffj(t) are stored as multiple data corresponding to the musical factor. For example, each formant waveform signal Ffj(t) is stored for each of a plurality of different timbres, each timbre formant waveform signal Ffj(t) is stored for each musical instrument part (tone pitch range), each musical instrument part (tone pitch range) formant waveform signal Ffj(t) is stored for each touch, each touch formant waveform signal Ffj(t) is stored for each elapsed time from the start of sounding, each envelope level or each envelope phase, and so forth.

Each formant waveform signal Ffj(t) is selected according to the repeat top data Ta from controller 20, and the repeat top data Ta are selected according to the musical factors, for example, timbres, touch, tone pitch (tone pitch range), etc., envelope phase, envelope level, elapsed time from the start of sounding or input data or select data by operator input from the performance data generator 10. The formant waveform signal Ffj(t) are also input from the performance data generator 10 by operator.

In this case, the formant control parameter Valj or the time count data which is changed according to the envelope data or elapsed time is synthesized to the musical factors by all kinds of calculations (1) will be described later in detail.

It is possible to omit the storage of data for each elapsed time from the start of sounding or each envelope level, and instead modify for synthesis the elapsed time from the start of sounding of envelope level with respect to the formant waveform signal Ffj(t). The modification synthesis is based on all kinds of calculations (1) to be described later in detail, and an operation (computation) device for the modification synthesis of the elapsed time from the sounding start or envelope level is provided at the output terminal of the formant waveform memory 53 shown in FIG. 10.

Accordingly, the program/data storage 21 includes a table relating the musical factor data, repeat top data Ta, repeat end data Ea, etc. to one another. In this table, data is stored as multiple data corresponding to the musical factors. For example, each of the data Ta and Ea is stored for each of a plurality of different timbres, the data for each timbre is stored for each musical instrument part (tone pitch range), the data for each musical instrument part (tone pitch range) is stored for each touch, the data for each touch is stored for each elapsed time from the sounding start, each envelope level or each envelope phase, and so forth.

Each of the data Ta and Ea are selected according to the repeat top data Ta from controller 20, and the repeat top data Ta are selected according to the musical factors, for example, timbres, touch, tone pitch (tone pitch range), etc., envelope phase, envelope level, elapsed time from the start of sounding or input data or select data by operator input from the performance data generator 10. Each of the data Ta and Ea are also input from the performance data generator 10 by operator.

In this case, the formant control parameter Valj or the time count data which is changed according to the envelope data or elapsed time is synthesized to the musical factors by all kinds of calculations (1) to be described later in detail.

It is possible to omit the storage of data for each elapsed time from the start of sounding or each envelope level, and instead modify for synthesis the elapsed time from the start of sounding of envelope level with respect to each of the repeat top data Ta and repeat end data Ea. The modification synthesis is based on all kinds of calculations (1) to be described later in detail, and an operation (computation) device for the modification synthesis of th elapsed time from the sounding start or envelope level is provided between the output terminal of the formant density storage unit 52 and the input terminal of the phase operation unit 51 shown in FIG. 10.

As noted before, there are various forms of formant of the formant waveform signal Ff(t), such as half triangular, pot-like, triangular, rectangular, half circular, hill-like, two-hill-like, etc., and also there are composite formants obtained by combining a plurality of like formants with or without overlap.

The formant waveform signal Ffj(t) which is read out on a time division basis from the formant waveform memory 53, is fed to an adder 54 for bias provision, i.e., addition of the formant waveform bias parameter dj(t), and the result is fed as formant waveform signal Fj(t) to the formant waveform generator 60. The bias provision, instead of the addition bias, may be the multiplication of the formant waveform signal Ffj(t) by the formant waveform bias parameter dj(t) or both the multiplication and addition or all kinds of calculations (1) to be described later in detail.

The formant density parameter ωfj(t) for each musical tone may be supplied directly from the controller 20. This transfer of parameter ωfj(t) from the controller 20 is made according to the musical factor data input from the performance data generator 10, such as the timbre, touch, tone pitch range, etc., the elapsed time from the sounding start, the envelope level, envelope phase or input data or select data by operator. To this end, the program/data storage 21 includes a table relating the musical factor data, etc. to the formant density parameter ωfj(t). The formant density parameter ωfj(t) are also input from the performance data generator 10 by operator.

Thus the density of frequency components of the formant of the formant waveform signal Ffj(t), and the formant position thereof of the formant waveform signal Ffj(t) on the frequency axis from the formant carrier signal, are changed according to the musical factor data such as the timbre, touch, tone pitch range, etc., the elapsed time from the sounding start, envelope level, envelope phase or input data or select data by operator etc. In this case, each parameter is stored as multiple data corresponding to the musical factors same as the data SP, O, Min, Ta, Ea, or the formant waveform signal Ffj(t).

In this case, as for the musical factors the formant control parameter Valj or the time count data which is changed according to the envelope data or elapsed time is synthesized by all kinds of calculations (1) to be described later in detail.

It is possible to omit the storage of data for each elapsed time from the sounding start or each envelope level and, instead, modify for synthesis the elapsed time from the sounding start of envelope level with respect to the formant density parameter ωfj(t). The modification synthesis is based on all kinds of calculations (1) to be described later in detail, and an operation (calculation) device for the modification synthesis of the elapsed time from the sounding start or envelope level is provided at the input terminal of an exclusive OR gate group 512 shown in FIG. 13.

8. Formant Density Storage unit 52

Figure 11:
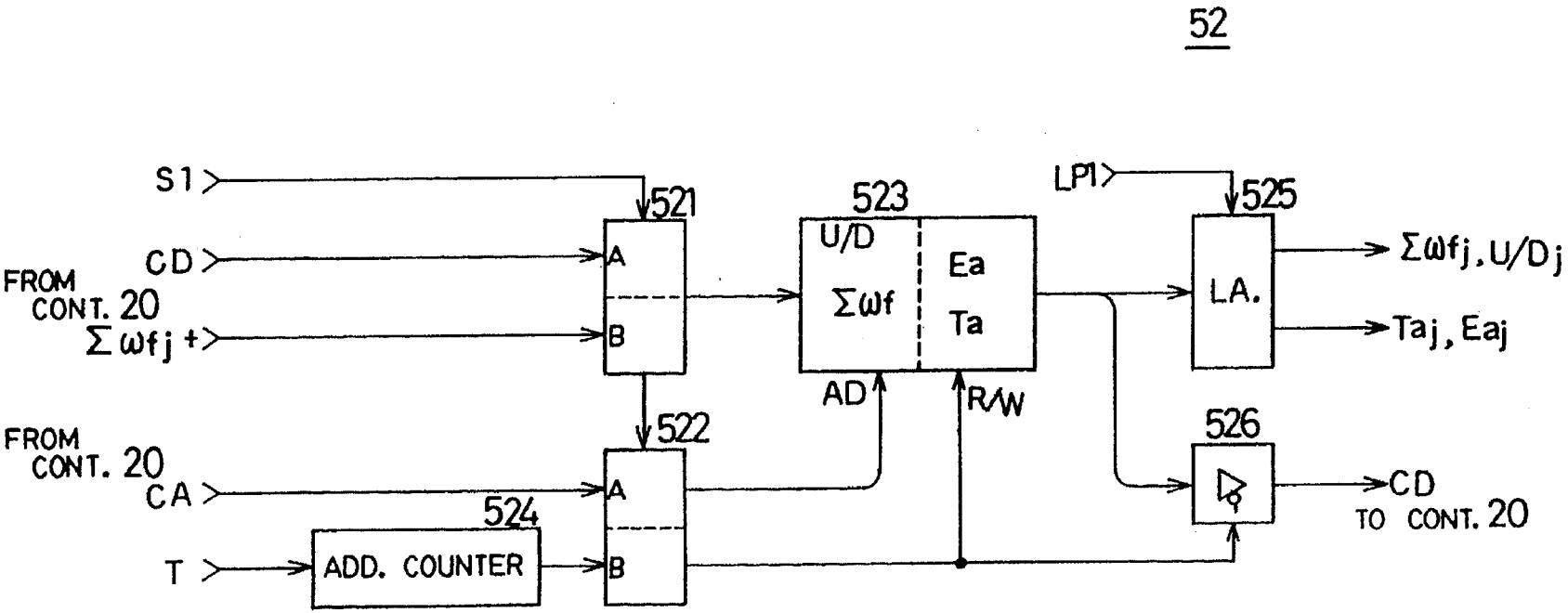
FIG. 11 is a circuit diagram showing a formant density storage 52.

FIG. 11 shows the formant density storage unit 52. This formant density storage unit 52 has substantially the same structure as the parameter storage 41 noted above. Formant control parameter CD from the controller 20 is coupled through a selector 521 to be written in a formant density memory 523. This parameter is written at the time of, for instance, the generation of event signal for sounding operation or the channel assignment to a musical tone to be sounded.

The formant control parameter CD consists of the repeat top data Ta, the repeat end data Ea and an up/down flat U/D. The repeat top data Ta and the repeat end data Ea indicate the first and last addresses, respectively, of an area of the formant waveform memory 53 in which the formant waveform signal Ffj(t) to be read out is stored. The up/down flat U/D indicates that the accumulation of the formant density parameter fj(t) is addition or subtraction.

The formant density parameter ωfj(t) which has been accumulated in the phase operation unit 51, i.e., cumulative formant density parameter Σωfj(t), is coupled through a selector 521 to be written in a formant density memory 523. The cumulative formant density parameter Σωfj(t) and formant control parameters Ta and Ea and U/D are stored in the formant density memory 523 in a number corresponding to the number of time division channels. The j-th channel cumulative formant density parameter Σωfj(t) and formant control parameters Taj, Eaj and U/Dj are fed through a latch 525 to the phase operation unit 51 and also fed through a tri-state buffer 526 to the controller 20 for such purposes as requesting formant control parameter CD necessary for the next operation.

Address data CA and read/write signal R/W are supplied from the formant density memory 523 through the controller 20 and selector 522 to the formant density memory 523 and also supplied through an address counter 524 and the selector 522 to the formant density memory 523. The read/write signal R/W is further supplied as set signal to the tri-state buffer 526.

A select signal S1 is supplied to the selectors 521 and 522 to switch data to be selected. A latch signal LP1 is supplied to the latch 525. The cycle period of the latch signal LP1 is equal to the channel division time. The latch signal LP1, select signal S1 and count signal T of the address counter 524 are supplied from the timing generator 30.

9. Operation of Formant Density Storage 52

Figure 12:
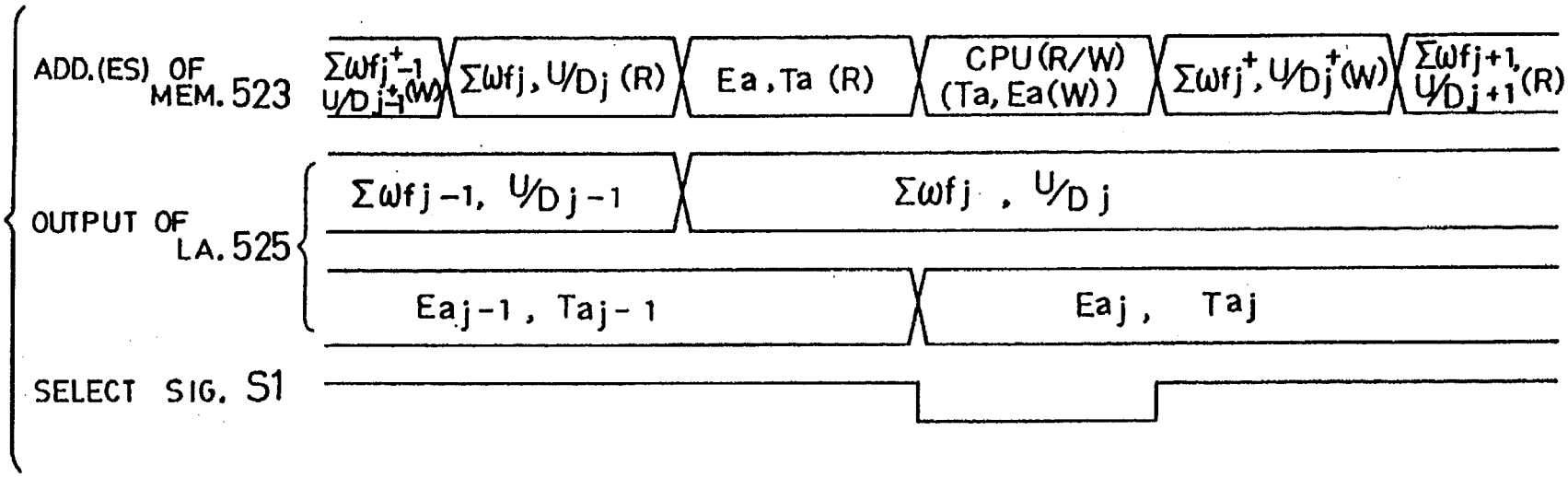
FIG. 12 is a time chart concerning the formant density storage 52.

FIG. 12 is a time chart illustrating the operation of the formant density storage unit 52. The reading of the j-th channel cumulative formant density parameter Σωfj(t) and up/down flat U/D, reading of the j-th channel repeat top data Taj and repeat end data Eaj, accessing of the controller 20, and writing of the cumulative formant density parameter Σωfj(t)+ and up/down flat U/Dj+ after the accumulation for the j-th channel, are executed repeatedly by sequential switching. The repeat top data Taj and repeat end data Eaj are written in the timing of accessing by the controller 20.

The output of the latch 525 is delayed by one step behind the above read and write timings, and thus it is as shown in FIG. 12. The select signal S1 is at a low level when and only when the controller 20 accesses.

10. Phase Operation Unit 51

Figure 13:
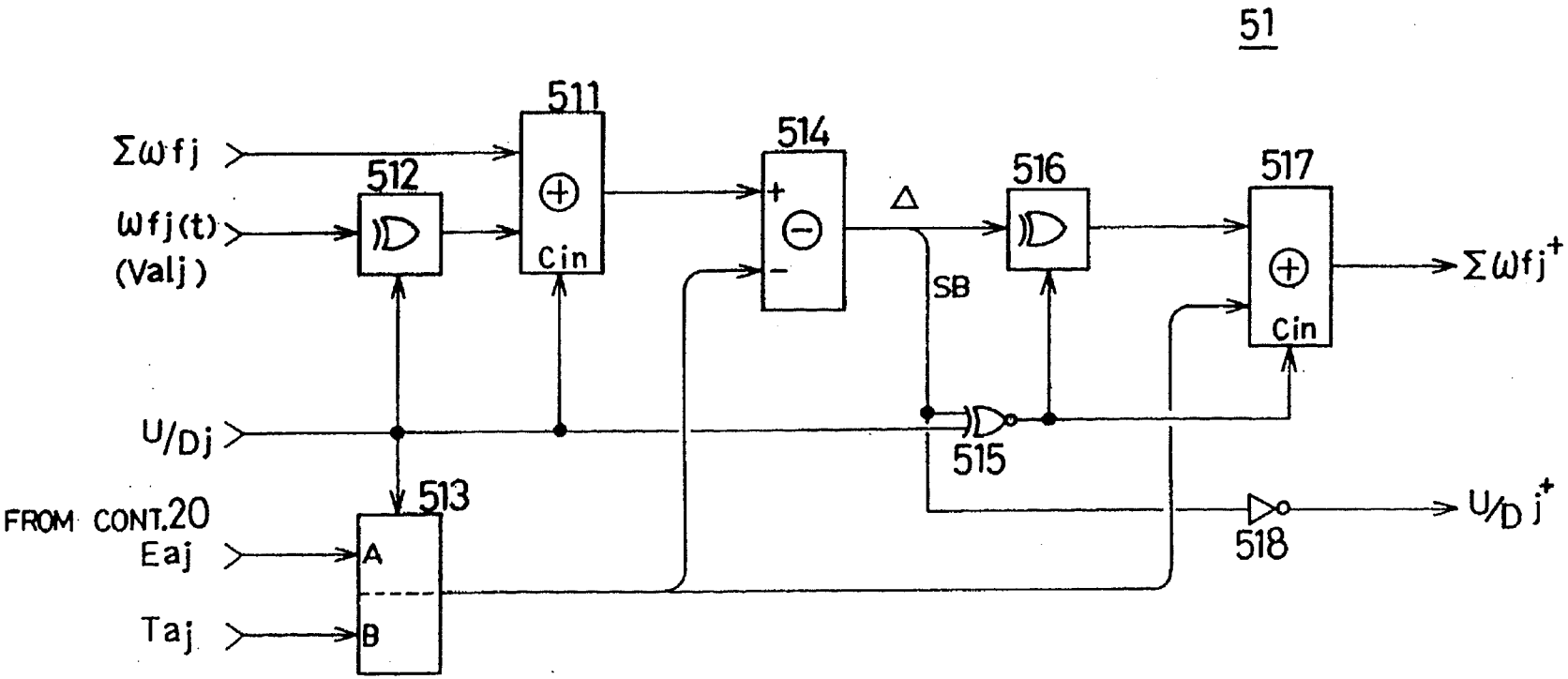
FIG. 13 is a circuit diagram showing a phase operation unit 51.

FIG. 13 shows the phase operation unit 51. The formant density parameter ωfj(t) from the formant control parameter generator 40 is coupled through an exclusive OR gate group 512 to an adder 511 for addition, i.e., accumulation, to the cumulative formant density parameter Σωfj(t) from the formant density storage unit 52. A subtracter 514 obtains difference data, i.e., arrival difference data Δj, between the sum output of the adder 511 and repeat top data Taj or repeat end data Eaj. The arrival difference data Δj is coupled through an exclusive OR gate group 516 to an adder 517 to be added to the repeat top data Taj or repeat end data Eaj, thus producing cumulative formant density parameter Σωfj (t)+ after accumulation which is fed to the formant density storage unit 52.

The up/down flag U/Dj from the formant density storage unit 52 is supplied to the exclusive OR gate group 512. When the accumulation of the formant density parameter ωfj(t) is subtraction, the formant density parameter ωfj(t) is sign inverted. A selector 513 selectively provides either of the repeat top data Taj and repeat end Eaj from the formant density storage unit 52 to the subtracter 514 and adder 517. The up/down flag U/Dj is supplied as select signal to the selector 513, which thus selects the repeat end data Eaj when the accumulation of the formant density parameter ωfj(t) is addition and selects the repeat top data Taj when the accumulation of the formant density parameter fj(t) is subtraction.

The up/down flag U/Dj is input to an exclusive NOR gate 515, to which the sign bit SB of the arrival difference data Δj from the subtracter 514 is also input. Thus, the exclusive NOR gate 515 can detect that the cumulative formant density parameter Σωfj(t) has exceeded the repeat top data Taj or repeat end data Eaj as a result of the accumulation. The detection signal from the exclusive NOR gate 515 is fed to the exclusive OR gate group 516 for sign inversion of the value of the arrival difference data Δj. The sign bit SB of the arrival difference data Δj is fed through an inverter 518 as up/down flag U/Dj to the formant density storage unit 52. It is possible as well that when the cumulative formant density parameter Σωfj(t) becomes more than the repeat end data Eaj, the cumulative formant density parameter Σωfj(t) is not subtracted but the parameter Σωfj(t) jump to the repeat top data Taj and the addition may be repeated.

Each formant waveform signal Ffj(t) is stored in the formant waveform memory 53 for one period or a plurality of periods. As the plurality of periods of the formant waveform signal Ffj(t), a plurality of periods of a rising (attack) portion and a plurality of periods of a portion subsequent to the rising are stored. The rising portion is read once, while the portion subsequent to the rising is read repeatedly. Alternatively, the whole waveform from the start till the end of sounding is stored and read out once.

In this case, the repeat top data Taj and repeat end data Eaj indicate the top and end of the portion that is repeatedly read out. The initial data Iaj indicate the top of the rising (attack) that is read out in sounding start. Thus, initial data Iaj is also stored in the formant density memory 523.

The initial data Iaj is determined by the controller 20 as one of the formant control parameters CD. Like the repeat top data Taj and repeat end data Eaj, it is determined according to the musical factor data, elapsed time from the sounding start, envelope level, envelope phase or input data or select data by operator etc., and it is written in the formant density memory 523. It is read out from the formant density memory 523 to be fed through the latch 525 to the formant waveform memory 53 and also fed to the phase operation unit 51.

In the phase operation unit 51, the initial data Iaj is output through a selector (not shown) as cumulative formant density parameter Σωfj(t)+. In the selector, the cumulative formant density parameter Σωfj(t)+ as the output of the adder 517 and the initial data Iaj are selected. To the selector, a key-on event signal is supplied as selection switching signal. At the time of sounding operation event signal generation or at the time of channel assignment to a musical tone to be sounded, the initial data Iaj is output as cumulative formant density parameter Σωfj(t)+ for successive accumulation.

This parameter Σωfj(t) (initial data Iaj) is written again through a selector 521 in the formant density storage unit 52 in the formant density memory 523. Subsequently, the cumulative formant density parameter Σωfj(t) is successively accumulated from the initial data Iaj toward the repeat end data Eaj, and further accumulation from the repeat top data Taj to the repeat end data Eaj is repeated.

11. Operation of Phase Operation Unit 51

Figure 14:
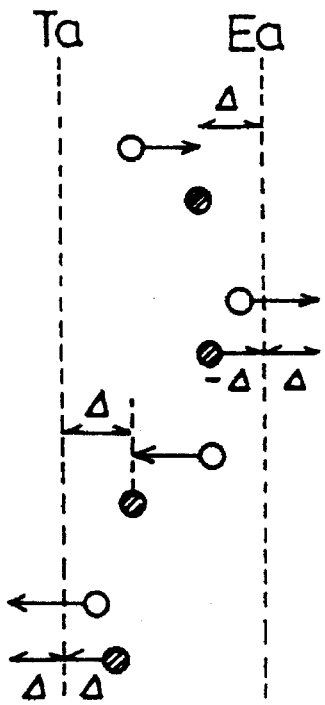
FIG. 14 is a view illustrating the operation of the phase operation unit 51.

FIG. 14 shows the relation between the operation in the phase operation unit 51 to accumulate the formant density parameter ωfj(t) and the repeat top and end data Ta and Ea. When the up/down flag U/D is indicative of addition and the sign bit of the arrival difference data Δj is negative, the output of the exclusive NOR gate 515 is at a low level, and the cumulative formant density parameter Σωfj(t)+ the formant density parameter ωfj(t) becomes to the repeat end data Ea+ arrival difference data Δj.

When the up/down flat U/D is indicative of addition and the sign bit of the arrival difference data Δj is positive, the output of the exclusive NOR gate 515 is at a high level, and the cumulative formant density parameter Σωfj(t)+ the formant density parameter ωfj(t) becomes to the repeat end data Ea− the arrival difference data Δj. Thus, fold-back correction is made when the repeat end data Ea is exceeded by the cumulative formant density parameter Σωfj(t).

When the up/down flag U/D is indicative of subtraction and the sign bit of the arrival difference data Δj is positive, the output of the exclusive NOR gate 515 is at a low level, and the cumulative formant density parameter Σωfj(t)+ the formant density parameter ωfj(t) becomes to the repeat top data Ta+ the arrival difference data Δj.

When the up/down flat U/D is indicative of subtraction and the sign bit of the arrival difference data Δj is negative, the output of the exclusive NOR gate 515 is at a high level, and the cumulative formant density parameter Σωfj(t)+ the formant density parameter ωfj(t) becomes to the repeat top data Ta− the arrival difference data Δj. Thus, fold-back correction is made when the repeat top data Ta is exceeded by the cumulative formant density parameter Σωfj(t).

12. Formant Waveform Generator 60

Figure 15:
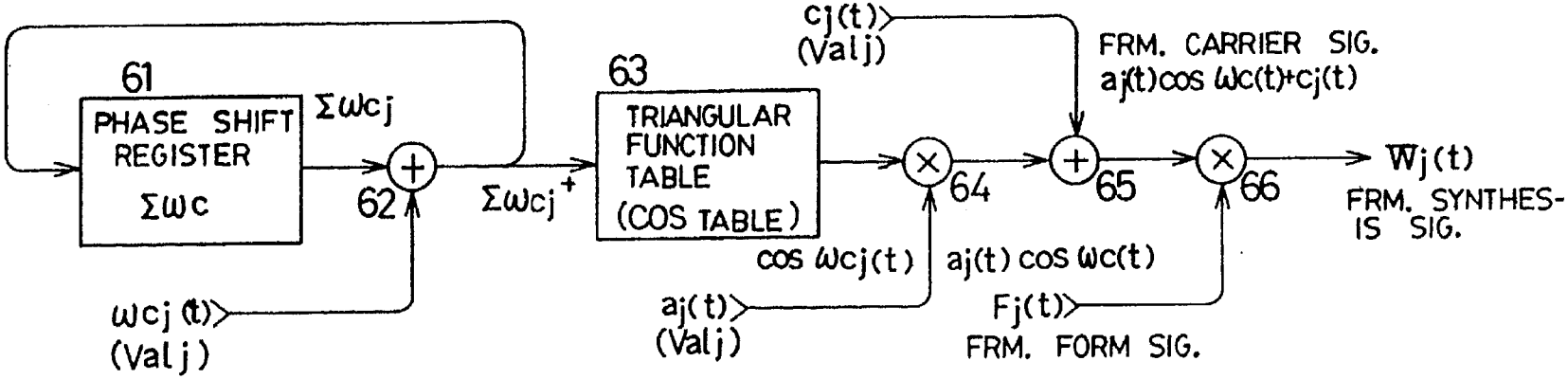
FIG. 15 is a circuit diagram showing a formant waveform generator 60.

FIG. 15 shows the formant waveform generator 60. Formant carrier parameter ωcj(t) is fed from the formant control parameter generator 40 to an adder 62 to be accumulated to cumulative formant carrier parameter Σωcj(t) from a phase shift register 61, and the output of the adder 62 is set again in the phase shift register 61. The phase shift register 61 has shift areas corresponding in number to the cumulative formant carrier parameters $\Sigma\omega cj(t)$ of all the channels. The all channel cumulative formant carrier parameters $\Sigma\omega cj(t)$ are thus stored and shifted successively to be output. The cumulative formant carrier parameter $\Sigma\omega cj(t)$ is supplied as read address data to a triangular function table (cos table) 63. In the triangular function table 63 cos waveform data are stored. These cos waveform data $\cos\omega cj(t)$ are read out on a time division basis as formant carrier signal Gj(t).

The formant carrier signal $\cos\omega cj(t)$ is multiplied in a multiplier 64 by the formant carrier level parameter aj(t) for such purposes as envelope control. The output of the multiplier 64 is fed to an adder 65 for adding the formant carrier bias parameter cj(t) to it. The output of the adder 65 is in turn fed to a further multiplier 66 to be multiplied by the formant waveform signal Fj(t). In this way, formant synthesis signal Wj(t) is obtained through the synthesis of the formant waveform signal Fj(t) on the formant carrier signal, and it is output to the accumulator 70. In this way, the formant waveform signal Fj(t) is synthesized on the formant carrier signal $\cos\omega cj(t)$ as formant center signal (fundamental wave).

The frequency of the formant carrier signal Gj(t) and the frequency of the formant waveform signal Fj(t) (Ffj(t)), can be selected independently to generate various different kinds of musical tones. The frequency of the formant carrier signal Gj(t) is determined by a designated tone pitch and also by various frequency data concerning formants, other frequency data, frequency modulation data, etc. The frequency of the formant waveform signal Fj(t) (formant waveform signal Ffj(t)), is determined by the musical factor data, such as the timbre, touch, tone pitch range, etc., elapsed time from the sounding start, envelope level, envelope phase or input data or select data by operator.

It is possible as well to generate the formant carrier signal $\cos\omega cj(t)$ using a digital signal processor, an operation circuit, etc. for executing an operation based on an operation formula. Further, it is possible to store in the cos table 63, instead of the cos waveform data, sin waves, triangular waves, trapezoid waves, rectangle waves, sawtooth waves and other complex waveform data containing harmonic components.

Further, it is possible to supply the formant waveform signal Fj(t) in lieu of the cumulative formant carrier parameter $\Sigma\omega cj(t)$ to the triangular function table 63. As a further alternative, it is possible to supply to the triangular function table 63 a signal obtained by adding or multiplying the formant waveform signal Fj(t) to or by the cumulative formant carrier parameter $\Sigma\omega cj(t)$. The synthesis of data from the formant waveform signal Fj(t), formant carrier Gj(t) and $\cos\omega cj(t)$ may be based on all kinds of calculations (1) to be described later in detail. It is thus possible to make the synthesis of the formant waveform signal Fj(t) on the formant carrier signal Gj(t) and $\cos\omega cj(t)$ complicated to permit generation of various musical tones.

The formant carrier parameter $\omega cj(t)$ may be fed directly to the controller 20. The transfer of data from the controller 20 is made according to the performance data such as tone pitch data input from the performance data generator 10. The program/data storage 21 has a table (frequency number memory) relating the tone pitch data, etc. to the formant carrier parameter $\omega cj(t)$. In this case, the formant carrier parameter $\omega cj(t)$ corresponds to the first formant at the lowest frequency among a plurality of formants of a musical tone, but it may correspond to the second formant, the third formant, etc. as well.

Further, the transfer of the formant carrier parameter $\omega cj(t)$ from the controller 20 is made according to the musical factor data from the performance data generator 10 such as the timbre, touch, tone pitch range, etc., the elapsed time from the sounding start, envelope level, envelope phase, input data or select data by operator, etc. The program/data storage 21 has a table relating the musical factor data, etc. to the formant carrier parameter $\omega cj(t)$. The formant carrier parameter $\omega cj(t)$ are also input from the performance data generator 10 by operator.

Thus, the frequency of the formant carrier signal Gj(t) is changed according to the musical factor data such as the timbre, touch, tone pitch range, etc., the elapsed time from the sounding start, envelope level of envelope phase, input data or select data by operator, etc. In this case, the formant carrier parameter $\omega cj(t)$ is stored as multiple data corresponding to the musical factors same as the data SP, O, Min, Ta, Ea, the formant waveform signal Ffj(t) or the formant density parameter $\Sigma\omega fj(t)$.

In this case, as for the musical factors the formant control parameter Valj or the time count data which is changed according to the envelope data or elapsed time is synthesized by all kinds of calculations (1) to be described later in detail.

It is possible to omit the storage of data for each elapsed time from the sounding start or envelope level, and instead, modify for synthesis the elapsed time from the sounding start or envelope level with respect to each formant carrier parameter $\omega cj(t)$. The modification synthesis is based on all kinds of calculations (1) to be described later in detail, and an operation (calculation) device for the modification synthesis of the elapsed time or envelope level is provided at the input terminal of an adder 62 shown in FIG. 15.

In this case, the formant carrier signal $\omega cj(t)$ corresponds to the second formant, third formant, etc. other than the first formant at the lowest frequency among a plurality of formants of one musical tone, but it may correspond to the first formant as well. The value of the formant carrier parameter $\omega cj(t)$ corresponding to the second formant, third formant, etc. is comparative data with respect to "1" which is the value of the formant carrier parameter $\omega cj(t)$ corresponding to the first formant, for instance "1.2", "1.5", "1.8", "2.0", "3.5", "4.9", etc. This comparative data is multiplied on the tone pitch data (frequency number data) of the first formant to obtain actual calculated formant carrier parameter $\omega cj(t)$.

The formant carrier signal Gfj(t), $\cos\omega cj(t)$ and formant waveform signal Ffj(t) corresponding to the first formant, the second formant, the third formant, . . . according to one musical sound of one operating sound start generate on a time division basis for each channel. In this case, a plurality of the formant carrier signal Gfj(t), $\cos\omega cj(t)$ and formant waveform signal Ffj(t) corresponding to each formants of one sound are all different or same in part.

The formant carrier signal $\{aj(t)\times\cos\omega cj(t)+cj(t)\}$, i.e., the formant center signal, may or may not be in accord with the formant peak center signal corresponding to the formant waveform signal Ffj(t)+dj(t). What is to be considered is a case when the formant carrier signal level is lower than the formant peak level. In the example shown in FIG. 4, with formant carrier signal level reduction a single formant peak at the center is changed to two peaks on the opposite sides of the center. In this case, the character of musical tone, such as the timbre, is also changed. This can be attained by adequately selecting the values of the formant control parameters aj(t), cj(t) and dj(t). Consequently, the character of musical tone can be changed according to the musical factor data, envelope data, data of the elapsed time from the sounding start, etc.

Instead of synthesizing the formant waveform signal Ffj(t) on the formant carrier signal cosωcj(t) by multiplication, it is possible to let the formant waveform signal Ffj(t) be output directly as musical tone by making the formant density parameter ωfj(t) to correspond to a designated tone pitch.

13. Accumulator 70

Figure 16:
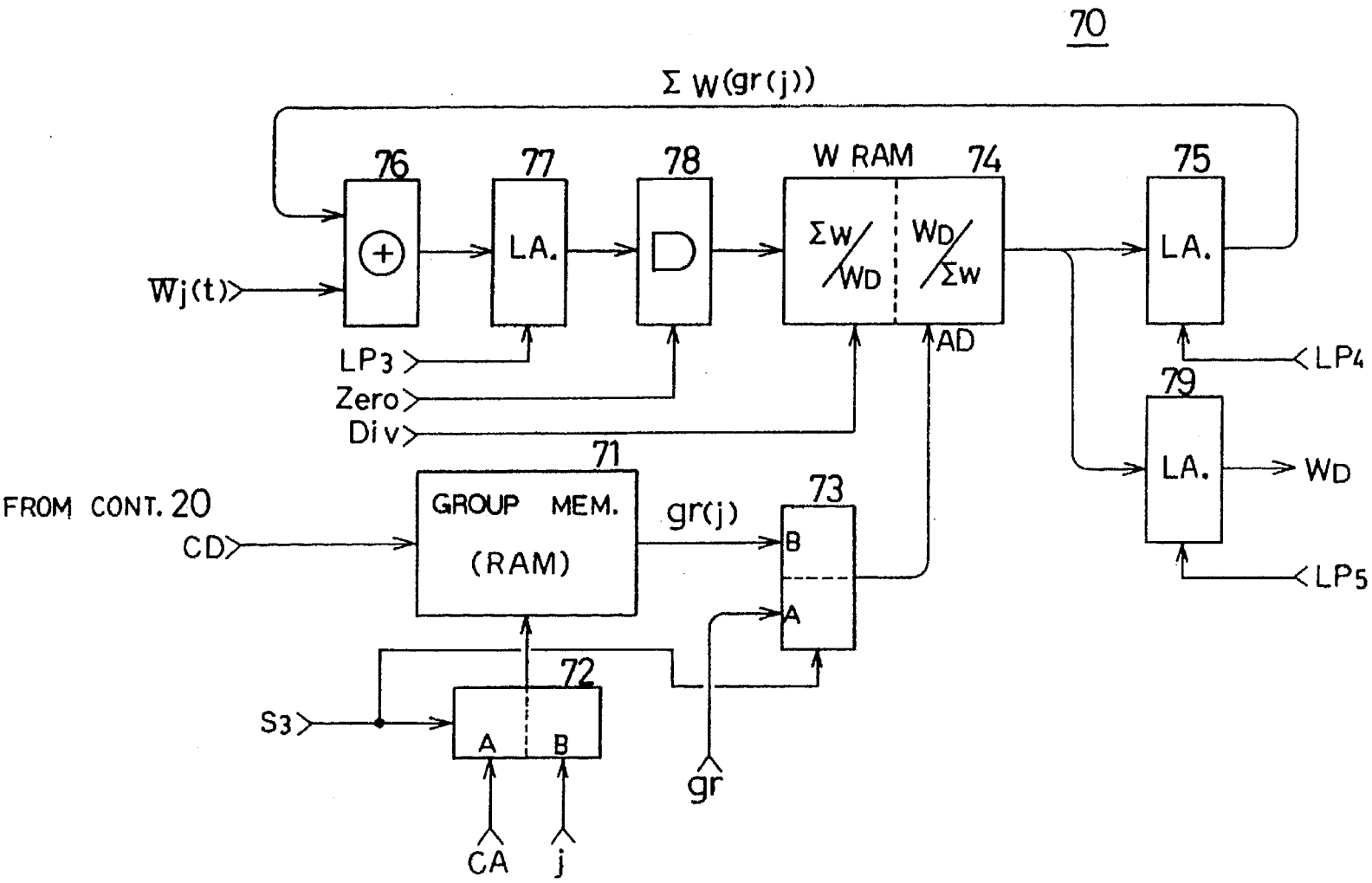
FIG. 16 is a circuit diagram showing an accumulator 70.

FIG. 16 shows the accumulator 70. Formant synthesis signal Wj(t) from the formant waveform generator 60 is fed to an adder 76 to be accumulated to cumulative formant synthesis signal ΣW(gr(j)) from a latch 75. The output of the adder 76 is fed through a latch 77 and an AND gate group 78 to be written in an accumulation memory 74. The accumulation memory 74 has two storage areas which are switched for writing and reading of data. The two storage areas of the accumulation memory 74 are divided for groups. The formant synthesis signal Wj(t) is accumulated for each group.

Cumulative formant synthesis signal ΣW(gr(j)) in the area in which data is being written, is successively accumulated for each group channel to be fed to the latch 75. Cumulative formant synthesis signal ΣW(gr(j)) in the area from which data is being read out is data after the end of accumulation for each group channel, and is fed through a latch 79 to the sound output unit 80.

The groups noted above each correspond to the musical factor data (or elapsed time from the sounding start, envelope level or envelope phase) or each sound of each channel formant synthesis signal Wj(t). Accumulation synthesis of the formant synthesis signal Wj(t) is made for each group. These processes for each group are carried out on a time division basis. This means that group channels are formed, which are different from the aforementioned channels to be assigned to musical tones. The musical factors that are corresponded by the groups are the timbre, touch, tone pitch range, stereo, etc. as noted above. As for the timbre, there may be a percussion instrument group and a strings/keyboard instrument group. As for the tone pitch range, there may be a high and a low tone pitch range. As for the stereo, there may be a left and a right stereo. Each group corresponding to each sound noted a plurality of formants in one sound of one operating sound generation.

Latch signals LP3 to LP5 are supplied to the respective latches 77, 75 and 79. A zero signal Zero which is inverted to a low level for each channel time is provided on the AND gate group 78 to clear cumulative formant synthesis signal ΣW(gr(j)) which has been output. A division switching signal Div is supplied to the accumulation memory 74 to switch the writing and reading of the cumulative formant synthesis signal ΣW(gr(j)).

In a group memory 71, group data gr of musical tone to which each channel is assigned, i.e., the formant synthesis signal Wj(t), is stored for each channel. Thus, the group memory 71 has storage areas corresponding to all the channels. If there are two different groups, the group data gr can assume values of "0" and "1". If there are four different groups, it can assume values of "00", "01", "10" and "11". The group data gr(j) for each channel is supplied successively as address data through a selector 73 to the accumulation memory 74. Further, group data gr from the sound output unit 80 or controller 20 is supplied as address data through the selector 73 to the accumulation memory 74.

The address data supplied from the controller 20 to the group memory 71 or time division channel number data j from a channel counter (not shown) in the timing generator 30, is supplied through a selector 72 to the group memory 71. Select signal S3 is supplied to the selectors 72 and 73 to switch the data to be selected. The select signal S3, the zero signal Zero and division switching signal Div are supplied from the timing generator 30.

14. Operation of Accumulator 70

Figure 17:
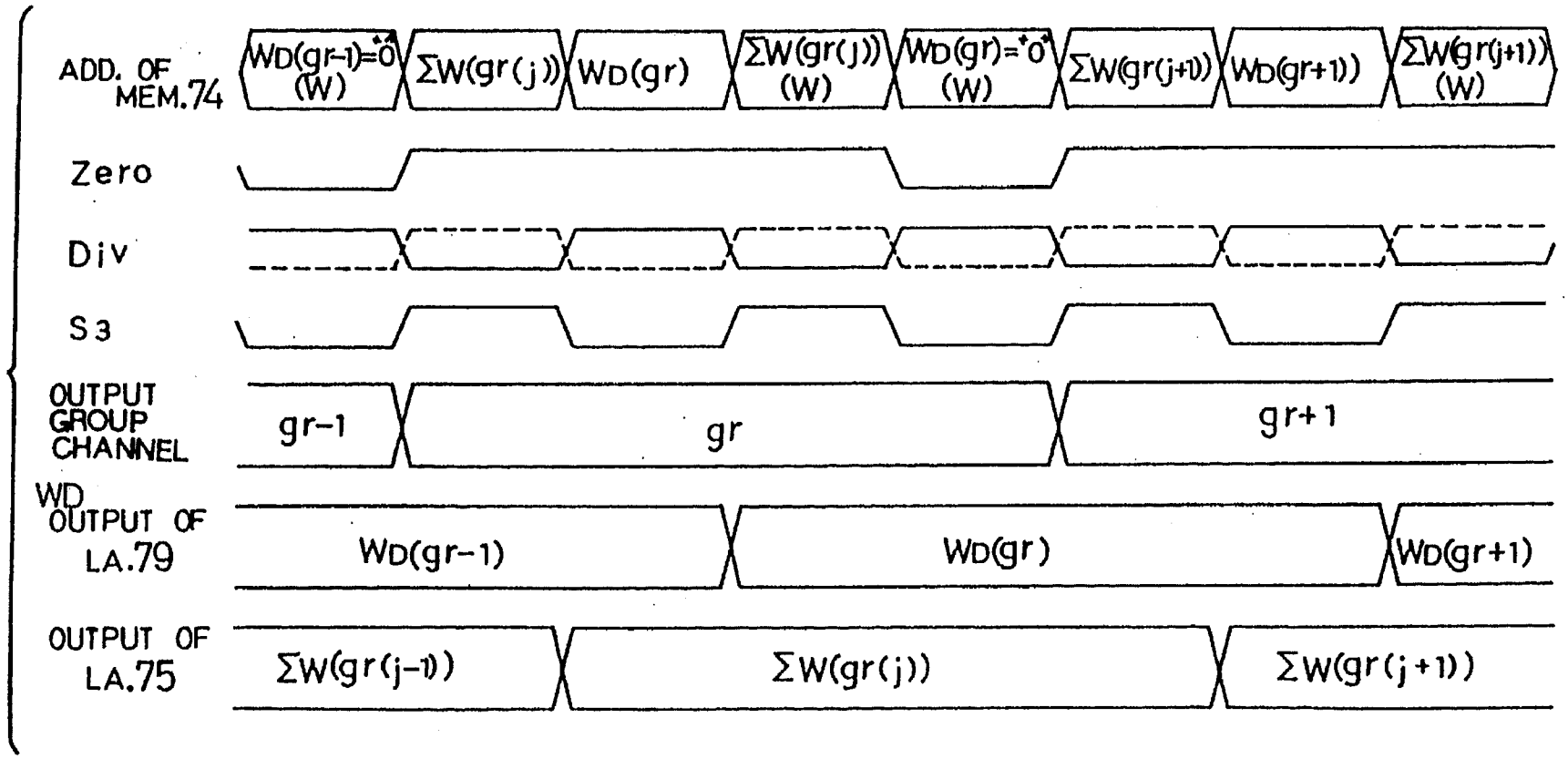
FIG. 17 is a time chart concerning the accumulator 70.

FIG. 17 is a time chart illustrating the operation of the accumulator 70. The reading of cumulative formant synthesis signal ΣW(gr(j)) after accumulation, reading of cumulative formant synthesis signal ΣW(gr(j)) after accumulation, writing of the cumulative formant synthesis signal ΣW(gr(j)) after the accumulation, and clearing of the cumulative formant synthesis signal ΣW(gr(j)) after the accumulation, are repeated sequentially for each group. The zero signal Zero is inverted to a low level when the cumulative formant synthesis signal ΣW(Gr(j)) after the accumulation is cleared.

When a cycle of accumulation for all the channels is completed, the division switching signal Div is switched from a signal shown by solid line in FIG. 17 to a signal shown by a dashed line. Thus, the two storage areas of the group memory 71 are switched, that is, the writing and reading are interchanged. The outputs of the latches 79 and 75 are each delayed by one step as the timing is shown in FIG. 17.

While the invention has been described in connection with the above embodiment, various changes and modifications of the embodiment may be made without departing from the scope and spirit of the invention. For example, it is possible to permit frequency modulation. In this case, a certain formant control parameter Valj is operated with respect to the cumulative formant carrier parameter ωcj(t) (Σωcj(t)) in the formant waveform generator 60. These operations may be all kinds of calculations (1) to be described later in detail.

Thus, frequency modulation is possible not only on the entire formant carrier signal cosωcj(t) or Gj(t) but also on each waveform component cosωcj(t) thereof. In this case, the formant control parameter Valj may be multiplied on or added to the cumulative formant control parameter Σωfj(t) in the formant waveform generator 50. By so doing, according to the frequency modulation the formant density can be subtly changed to change the timbre.

Further, the cumulative formant density parameter Σωfj(t) for reading the formant waveform signal Ffj(t) in the formant waveform memory 53 may be replaced with cumulative formant carrier parameter Σωcj(t) corresponding to a tone pitch or the like. In this case, the formant carrier parameter ωcj(t) is supplied instead of the formant density parameter ωfj(t) to the phase operation unit 51.

Further, with respect to a single sounding operation or a single tone pitch a plurality of time division channels may be assigned simultaneously to a plurality of musical tones. Among such plurality of musical tones are left and right tone waveform data tones forming stereo positions, fundamental wave part tones and harmonic part tones, rising, intermediate and attenuating part tones from the start till the end of tone sounding, tones corresponding to the first, second and so forth formants, and so forth. In this case, the combination of formant waveform signals Ffj(t) which are of the tones with the assigned channels thereto and are read out from the formant waveform memory 53, is selected by switching according to the musical factors such as the timbre, touch, tone pitch range, etc., elapsed time from the sounding start, envelope level or envelope phase. Further, instead of multiplication synthesizing the formant waveform signal Fj(t) on the formant carrier signal Gfj(t) and cosωcj(t), it is possible to permit formant density parameter ωfj(t) corresponding to a designated pitch to be provided for directly outputting the formant waveform signal Fj(t) as musical tone.

It is possible to use fluctuations (wavering, swings, sways) data FL from a fluctuation data memory 321 or frequency or amplitude modulation data FM1 to FM3, SFM, AM1 to AM3 or SAM described in specification U.S. patent application Ser. No. 08/172,146 (Japanese Patent Application No. 04-230136 and 04-346063) as the parameter values Valj(ωfj(t), ωcj(t), aj(t), cj(t), ωcjk(t), ajk(t), dj(t)), ωcjk(t), ajk(t) and cj(t).

The above parameter storage 41 (i.e., parameter memory 411), formant density storage unit 52 (i.e., formant density memory 523) and formant waveform memory 53, may be combined into a single memory or two memories, for time division reading and writing of each data. Such combined memory may include the phase shift register 61, cos table 63, accumulation memory 74, group memory 71, program/data storage 21, etc. All the processes of addition and subtraction and additive synthesis described above mean biasing, and all the processes of multiplication and division and multiplific synthesis mean weighting.

The formant waveform signal Ffj(t) stored in the formant waveform memory 53 or the formant carrier signal Gj(t) stored in the formant waveform control unit 60 may represent time-wise part sound, envelope part sound or band-wise part sound. The time-wise part sound is one of sounds corresponding to a rising (attack), a subsequent-to-rising and an attenuation (release) part of a musical tone. The envelope part sound is one of attack, decay, sustain and release parts of a musical tone. The band-wise part sound is one of a low, an intermediate and a high pitch range part of a musical tone, and these part sounds may be overlapped by each other.

For the time-wise part sound, the read start moment is determined according to the elapsed time from the start of sounding. For the envelope part sound, it is determined according to the envelope phase. For the band-wise part sound, it is determined according to the envelope level or musical factor.

Further, the multiplication or division process or multiplific process by the multiplier may be replaced with an addition or subtraction process or an additive process. In this case, the signal, data or parameter to be multiplied or divided is converted by a logarithmic converter or into a logarithmic value from the instant of generation, then added in an adder and then inversely converted in an exponential converter.

It is possible to process the formant control parameter Valj indicative of the elapsed time from the sounding start, cumulative formant density parameter Σωcj(t) or time count data from synthesis with the cumulative formant carrier parameter Σωcj(t) (Σωcjk(t)) in the formant waveform generator 60 or weighting interpolation circuit 80 in FIG. 15, formant carrier parameter ωcj (t) (ωcjk (t)) (comparative data), formant control parameter aj(t) or cj(t) (ajk(t) or cjk(t)), cumulative formant density parameter Σωfj(t) (Σωfjk (t) shown in FIG. 10, formant density parameter ωfj(t)(ωfjk (t)), formant control parameter dj(t) (djk(t)) or speed data SP.

Further, the values of the parameters ωcj(t), ωfj(t), aj(t), cj(t) (ωcjk(t), ajk(t), dj(t)), ωcjk(t), ajk(t) and cj(t), data Ta, Ea, SP, O and Min, etc., in the moment of sound starting, may be stored, and after the lapse of a certain time from the start of sounding the data indicative of the elapsed time from the sounding start or envelope data may be synthesized with the value of the parameter ωcj(t) or the like. This operation and synthesis may be synthesis in all kinds of calculations (1) to be described later in detail.

In this case, the data indicative of the elapsed time from the start of sounding or envelope level data may be converted to weighted data and the weighted data may be synthesized in the above operation and synthesis. Alternatively, weighted data stored in a table may be read out according to the elapsed time data or envelope data as address data, and the elapsed time from the start of sounding or envelope level data is converted and operated to weighted data. The weighted data may be fixed or variable and may take either positive or negative values.

Further, of each parameter ωcj(t) or the like that is stored for each musical factor, only a typical value may be stored while other values are stored as comparative data or differential data with respect to the typical value, and at the time of reading the comparative or differential data may be operated on the typical value.

Said "all kinds of calculations (1)" are an addition or a subtraction in an adder, a multiplication or a division in a multiplier, an operation (calculation, computation) combined with these additions, subtractions, multiplications and divisions in adder and multiplier, a bit shift operation (calculation, computation) of one of two data by the other in data shifter, a combine (synthesis) operation (calculation, computation) of making one of two data to be upper data and the other to be lower data, an operation (calculation, computation) of the each data with an operation (calculation, computation) formula (expression) in an operation (calculation, computation) circuit, data operated (calculated, computed) on each data are stored in a memory and reading out of the operated (calculated, computed) data by making the each data to reading address data of the memory, etc.

What is claimed is:

1. An apparatus for generating musical tones comprising:

formant waveform signal storage means for storing formant waveform signals having waveforms synthesized from frequency components of formants of musical tones;

reading means for reading a formant waveform signal from said formant waveform storage means;

formant density data generating means for generating formant density data indicative of the density of the frequency components of a formant of the formant waveform signal read out by said reading means;

reading control means for controlling, during the reading of the formant waveform signal by said reading means, the density of the frequency components of the formant of the formant waveform signal according to the formant density data generated from said formant density data generating means;

formant center frequency data generating means for generating formant center frequency data of a formant center signal for synthesis as a center signal with the formant waveform signal read out by said reading means, the formant center frequency data being independent of the formant density data;

formant center signal generating means for generating the formant center signal at a frequency corresponding to the formant center frequency data generated by said formant center frequency data generating means; and synthesizing means for synthesizing formant waveform signals with a formant, which has a density of frequency components controlled by said reading control means, on the formant center signal generated from said formant center signal generating means.

2. The apparatus for generating musical tones according to claim 1, wherein the formant density data indicates the width of the formant of the formant waveform signal.

3. The apparatus for generating musical tones according to claim 1, wherein said formant waveform signal storage means stores plural kinds of formant waveform signals for at least one of: each musical tone, each elapsed time from a start of sounding, each of a plurality of musical factors, each envelope level and each envelope phase; and further wherein the formant waveform signal being read out corresponds to at least one of: a designated musical tone, an elapsed time from sounding start, a musical factor, an envelope level, an envelope phase, and an input chosen by an operator.

4. The apparatus for generating musical tones according to claim 1, wherein the formant density data is changed according to at least one of: a musical factor, an elapsed time from a start of sounding, an envelope level, an envelope phase, and an input chosen by an operator.

5. The apparatus for generating musical tones according to claim 1, wherein a plurality of signals are generated for each sounding designation, the signals being one of: formant waveform signals and formant center signals.

6. The apparatus for generating musical tones according to claim 1, wherein the formant center frequency data is generated in accordance with a designated tone pitch, and of a plurality of formant center signals operated for each sounding designation the one having the lowest frequency corresponds in frequency to the designated tone pitch.

7. The apparatus for generating musical tones according to claim 1, wherein the amplitude of the formant center signal generated from said formant frequency center signal generating means is different than the amplitude of the formant waveform signal read out by said reading means and changed according to at least one of: a musical factor, an elapsed time from sounding start, an envelope level, an envelope phase and an input chosen by an operator.

8. The apparatus for generating musical tones according to claim 1, where said reading means reads out a plurality of formant waveform signals on a time division basis, said formant density data generating means generates a plurality of formant density data on a time division basis, said reading control means controls the density of each frequency components of formant of a plurality of formant waveform signals on a time division basis, said formant center frequency data generating means generates frequency data of a plurality of formant center signals on a time division basis, and said synthesizing means synthesizes a plurality of formant waveform signals on a plurality of formant signals on a time division basis.

9. The apparatus for generating musical tones according to claim 3, wherein said formant waveform signal storage means stores a different formant waveform signal for each of a plurality of musical factors, the musical factor being changed according to one of elapsed time and envelope data.

10. The apparatus for generating musical tones according to claim 4, wherein the formant density data is changed according to a musical factor, the musical factor being changed according to one of elapsed time and envelope data.

11. A method of generating musical tones comprising:

(A) storing formant waveform signals having waveforms synthesized from frequency components of formants of musical tones;

(B) reading a formant waveform signal stored in said step (A);

(C) generating formant density data indicative of the density of frequency components of a formant corresponding to the formant waveform signal read out in said step (B);

(D) controlling, during the reading of the formant waveform signal in said step (B), the density of the frequency components of the formant of the formant waveform signal according to the formant density data generated in said step (C);

(E) generating formant center frequency data of a formant center signal for synthesis as a center signal with the formant waveform signal read out in said step (B), the formant center frequency data being independent of the formant density data generated in said step (C);

(F) generating the formant center signal at a frequency corresponding to the formant center frequency data generated in said step (E); and (G) synthesizing formant waveform signal with a formant, which has a density of frequency components controlled in said step (D), on the formant center signal generated in said step (F).

12. The method of generating musical tones according to claim 11, wherein the formant density data indicated the width of the formant of the formant waveform signal.

13. The method of generating musical tones according to claim 11, wherein in said step (A) a plurality of different formant waveform signals are stored for at least one of: each of a plurality of tones, each of a plurality of musical factors, each elapsed time from sounding start, each envelope level, and each envelope phase; a formant waveform signal being read out in correspondence to at least one of: a designated musical factor, an elapsed time from a start of sounding, an envelop level, an envelope phase and an operator's setting designation.

14. The method of generating musical tones according to claim 11, wherein the formant density data is changed according to at least one of: a musical factor, an elapsed time from a start of sounding, an envelope level, an envelope phase and an input chosen by an operator.

15. The method of generating musical tones according to claim 11, wherein a plurality of signals are generated for each sounding designation, the signals being one of: formant waveform signals and formant center signals.

16. The method of generating musical tones according to claim 11, wherein the formant center frequency data is determined according to a designated tone pitch, and of plurality of formant center signals operated for each sounding designation the one having the lowest frequency corresponds in frequency to the designated tone pitch.

17. The method of generating musical tones according to claim 11, wherein in said step (B) a plurality of formant waveform signals are read out on a time division basis, in said step (C) a plurality of formant density data are read out on a time division basis, in said step (D) the density of frequency components of formant of a plurality of formant waveform signals is controlled on a time division basis, in said step (E) frequency data of a plurality of formant center signals are generated on a time division basis, in said step (F) a plurality of formant center signals are generated on a time division basis, and in said step (G) a plurality of formant waveform signals are synthesized on a plurality formant center signals.

18. The method of generating musical tones according to claim 13, wherein in said step (A) a different formant waveform signal is stored for each of a plurality of musical factors, the musical factor being changed according to one of elapsed time and envelope data.

19. The method of generating musical tones according to claim 14, wherein the musical factor is changed according to one of elapsed time and envelope data.

20. An apparatus for generating musical tones comprising:

formant waveform signal storage means for storing a plurality of formant waveform signals having different waveforms synthesized from specific frequency components of formants of musical tones;

reading means for reading a formant waveform signal stored in said formant waveform storage means;

reading rate designating means for designating the rate of reading of formant waveform signal stored in said formant waveform storage means;

reading control means for causing said reading means to read data at a rate corresponding to the reading rate designated by said reading rate designating means;

musical factor generating means for generating a musical factor; and switching means for switching, after a first formant waveform signal has been read out from said formant waveform signal storage means according to the generated musical factor, to a different, subsequent formant waveform signal to be read out from said formant waveform signal storage means, the different, subsequent formant waveform signal being read out by said reading means according to the musical factor generated by said musical factor generating means.

21. The apparatus for generating musical tones according to claim 20, wherein the musical factor generated from said musical factor generating means is one of timbre data, touch data, tone pitch data and tone pitch range data.

22. The apparatus for generating musical tones according to claim 20, wherein said musical factor generating means changes the musical factor according to one of elapsed time and envelope data.

23. The apparatus for generating musical tones according to claim 20, wherein the musical factor generated from the musical factor generating means is one of: the elapsed time from a start of sounding, an envelope level, an envelope phase, and an input chosen by an operator.

24. The apparatus for generating musical tones according to claim 20, wherein a plurality of formant waveform signals are operated for each sounding designation.

* * * * *